US005443558A

United States Patent [19]

Ibaraki et al.

[11] Patent Number: 5,443,558

[45] Date of Patent: Aug. 22, 1995

[54] ENGINE POWER REGULATOR

[75] Inventors: Toshikazu Ibaraki, Susono; Naoto Kushi, Toyota, both of Japan

[73] Assignee: Toyota Jidosha Kabushiki Kaisha, Toyota, Japan

[21] Appl. No.: 245,081

[22] Filed: May 17, 1994

[30] Foreign Application Priority Data

May 21, 1993 [JP] Japan ..... 5-120276

[51] Int. Cl.[6] ..... F02D 9/06

[52] U.S. Cl. ..... 123/325

[58] Field of Search ..... 123/325, 336, 337, 340, 123/399; 364/431.11

[56] References Cited

U.S. PATENT DOCUMENTS

| | | | |
|---|---|---|---|
| 4,599,695 | 5/1984 | Deutsch | 364/431.11 |
| 4,697,559 | 10/1987 | Suzuki et al. | 123/325 |
| 4,870,934 | 10/1989 | Vanetta et al. | 123/336 |
| 5,002,028 | 3/1991 | Arai et al. | 123/399 |
| 5,337,715 | 8/1994 | Gonzales, Jr. et al. | 123/325 |

FOREIGN PATENT DOCUMENTS

| | | | |
|---|---|---|---|
| 62-35039 | 2/1987 | Japan | 123/325 |
| 4365934 | 12/1992 | Japan | 123/325 |

*Primary Examiner*—Raymond A. Nelli
*Attorney, Agent, or Firm*—Kenyon & Kenyon

[57] ABSTRACT

An apparatus for regulating power produced by a motor vehicle engine is disclosed. The apparatus cooperates in association with throttling valves and engine power moderating devices. The apparatus has first detecting device for detecting the operating condition of said engine. The detecting device generates a signal in response to detected engine condition. The apparatus further has a second detecting device for detecting a malfunction in the throttle valves and generates a signal in response to the detected malfunction. A controller functions responsive to the signals generated by the first and second detecting devices for generating first and second engine power values representative of range of engine power in accordance with said operating condition prior to the occurrence of malfunction of the throttle valves. The controller controls the engine power moderating device to moderate engine power based on the first and second engine power values.

20 Claims, 20 Drawing Sheets

ENGINE POWER REGULATOR

BACKGROUND OF THE INVENTION

1. Field of the Invention

The present invention generally relates to an apparatus for controlling the power output of a throttle controlled engine given a malfunction in the throttle control. More particularly, an engine controller regulates engine speed and power by modulation the supply of fuel or the selection of transmission gearing to maintain engine power at a level preceding the malfunction.

2. Description of the Related Art

Generally, a vehicles engine speed or velocity is in large part determined by the drivers manipulation of an acceleration pedal or similar means. Such means are usually mechanically coupled via a wire or the like to a throttle valve provided in the air-intake passage of the engine. The amount of the movement (angle) of this valve is specifically controlled in accordance with the mount of the pedal manipulation. The action of the valve controls the amount of air led into the engine via the air-intake passage.

Recently, throttle valves have been introduced which, are not mechanically couple to a pedal. One example of such a valve is used in an engine controller disclosed in Japanese Unexamined Patent Publication No. 62-35039.

A throttle controller is shown in FIG. 25 that uses a potentiometer 72 to detect the amount by which the driver manipulates the accelerator pedal 71. Based on the detected manipulation amount, a first control circuit 74 determines a target angle for a throttle valve 73. With the target angle as a control value, a step motor 75, controlled by the control circuit 74, manipulates the angle of the valve 73 to control the engine power.

Should there be a malfunction with either the throttle control system or the step motor, there should be some means for controlling the throttle. Conventional controllers, such as in Japanese Unexamined Publication No. 62-35039, use the following structure as a backup system.

The rotational speed of the engine ("engine speed") is detected by a crank angle sensor 76 which detects the rotational angle of the crankshaft. Based on the detected engine speed, a second control circuit 77 determines a target amount of fuel to be injected into the engine, and assigns a value to that amount. Based on the target value, the second control circuit 77 controls a fuel injector 78 which delivers the target amount of fuel, determined by control circuit 77, to the engine. By using throttle sensor 79, a signal based on the angle of the throttle valve 73 is supplied to the first control circuit 74 which determines if the throttle control system has failed. In this example, if the throttle angle is zero when the valve 73 should be fully open, the throttle control system is considered as having malfunctioned.

Depending on the engine speed detected by the crank angle sensor 76, the first control circuit 74 determines whether the electric sensor system or sensor 76 has failed. When the first control circuit 74 determines that a failure has occurred in throttle control system, fuel injection is intermittently interrupted or cut (fuel cut) by the injector 78. This effectively controls the fuel supply to the engine so that the engine speed becomes equal to or lower than a preset reference value, despite the current engine speed. Excessive engine speeds can thus be avoided in circumstances where the throttle control system has failed. When the difference between the value of the engine speed upon occurrence of the failure and the reference value is relatively large, the engine is rapidly decelerated at the instant when the failure is detected. The engine in that case undergoes a noticeable and sometimes rapid deceleration.

Upon the detection of a failure in either the throttle control system or the electric sensor system, an uninterrupted fuel cutting procedure is instituted irrespective of the particular engine speed or velocity at the time of fuel cutting.

Depending on the particular engine speed or velocity at the time of fuel cutting, the engine deceleration may degrade the optimum performance and drivability characteristics of the vehicle.

SUMMARY OF THE INVENTION

Accordingly, it i a primary objective of the present invention to provide an engine power regulator on the occurrence of a malfunction in the throttle valve system that is capable of maintaining the engine speed and power at levels occurring prior to the malfunction.

It is another objective of this invention to provide an engine power regulator capable of compensating for changes in engine speed during a throttle valve system malfunction to preserve the vehicles optimum drivability characteristics.

It is a further objective of this invention to provide an engine power regulator that allows the engine's operator to feel the occurrence of a malfunction in the throttle valve system, and which ill minimize the effects of deceleration resulting from the throttle system's malfunction.

To achieve the foregoing and other objects and in accordance with the purpose of the present invention, an apparatus for regulating power produced by a motor vehicle engine cooperating in association with a throttles and engine power moderating means is provided. The apparatus comprises a first detecting device for detecting the operating condition of said engine and for generating a signals in response thereto. The apparatus further includes a second detecting device for detecting of a malfunction in the throttles and for generating a signal in response thereto. A control device is also provided in he apparatus. The control device is responsive to the signals generated by the first and second detecting devices for generating first and second engine power values representative of a range of engine power in accordance with the operating condition prior to the occurrence of malfunction of said throttle means. The control device controls the engine power moderating devices to moderate engine power based on the first and second engine power values.

BRIEF DESCRIPTION OF THE DRAWINGS

The features of the present invention that are believed to be novel are set forth with particularity in the appended claims. The invention, together with objects and advantages thereof, may best be understood by reference to the following description of the presently preferred embodiments together with the accompanying drawings in which:

FIG. 1 is a schematic structural diagram showing a gasoline engine system adapted for a front-engine rear-wheel drive automobile;

FIG. 2 is a schematic structural diagram showing the layout of a subthrottle valve and a main throttle valve;

FIG. 3 is a map of an acceleration pedal angle (ACCP) v.s. a main throttle angle (TAM) and a subthrottle angle (TAS);

FIG. 4 is a block diagram showing various electrical components used in the first embodiment of the present invention;

FIG. 5 is a flowchart illustrating a fuel cutting routine that is executed by a first ECU;

FIG. 6 is a continuation of the fuel cutting routine illustrated in FIG. 5;

FIG. 7 is a flowchart illustrating a fuel injection control routine that is executed by the first ECU;

FIG. 8 graphically illustrates the relationship among a current engine speed (NE), a fuel-cut engine speed (FNE), a fuel-supply engine speed (FRT), a lower-limit engine speed (NRT), etc. in the fuel modulation routine;

FIG. 9 is a further graphical illustration of the relationship among engine speed NE, fuel-cut engine speed FNE, fuel-supply engine speed FRT, lower-limit engine speed NRT, etc. during the fuel modulation process;

FIG. 10 is yet another graphical illustration of the relationship among ;he engine speed NE, fuel-cut engine speed FNE, fuel-supply engine speed FRT, lower-limit engine speed NRT, etc. during the fuel modulation routine; and FIG. 11 is still another graphical illustration of engine speed, fuel-cut engine speed, fuel-supply engine speed, lower-limit engine speed, etc. during the fuel modulation routine.

FIG. 12 is a flowchart illustrating a fuel cutting routine executed by a first ECU;

FIG. 13 is a continuation of the fuel cutting routine illustrated in FIG. 12;

FIG. 14 is a continuation of the fuel cutting routine illustrated in FIGS. 12 and 13;

FIG. 15 is a continuation of the fuel cutting routine illustrated in FIGS. 12 to 14;

FIG. 16 is a continuation of the fuel cutting routine illustrated in FIGS. 12 to 15;

FIG. 17 is a graphical illustration of the relationship among vehicle engine speed NE and the various control parameters used during the operation of the fuel modulation routine;

FIG. 18 is a chart further graphically illustrating the relationship among the engine speed NE and the various control parameters used during the operation of the fuel modulation routine.

FIG. 19 is a flowchart illustrating a gear downshift routine executed by a first ECU;

FIG. 20 is a continuation of the routine illustrated in FIG. 19;

FIG. 21 is a flowchart illustrating a gear ratio control routine that is executed by the first ECU;

FIG. 22 is a graphical illustration of vehicle speed modulation according to the third embodiment;

DETAILED DESCRIPTION OF THE PREFERRED EMBODIMENTS

The first to third embodiments of the present invention will now be described below. The basic mechanical and electric structures of a gasoline engine system for an automobile according to the present invention will be explained in the following description of the first embodiment. In the descriptions of the second and third embodiments, only the differences between each embodiment and the first embodiment will be discussed.

(First Embodiment)

An apparatus to regulate the power of a motor vehicle in the event of a throttle valve system malfunction according to the first embodiment of the present invention will now be described referring to FIGS. 1 through 11.

Figure 1:
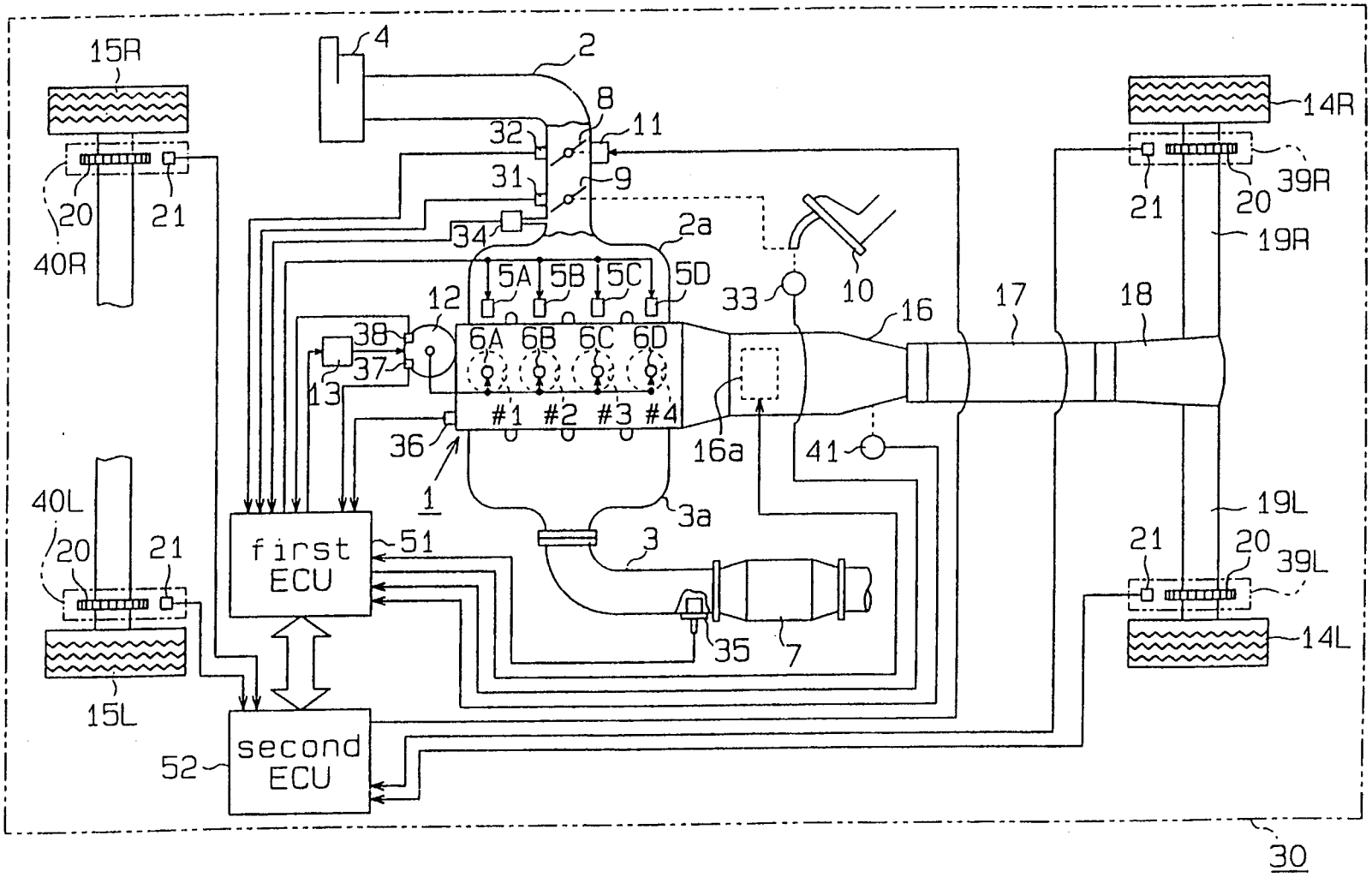
FIGS. 1 through 11 illustrate an engine power regulator according to a first embodiment of the present invention.

FIG. 1 illustrates the schematic structure of a gasoline engine system for a front wheel real wheel drive type automobile, to which the engine power regulator according to the present invention is adapted. An engine 1 mounted on a vehicle 30 includes an air-intake passage 2 and an exhaust passage 3, and an air cleaner 4 disposed at the inlet side of the air-intake passage 2. The downstream side of the air-intake passage 2 is coupled to the individual cylinders of the engine 1 (four cylinders in this embodiment) via a branched intake manifold tube 2*a*.

In the vicinity of the intake manifold tube 2*a*, fuel injectors 5A, 5B, 5C and 5D) are provided in association with the individual cylinders 1 through 4. As is well known, fuel is supplied from a fuel tank (not shown) to the individual injectors 5A to 5D by a fuel pump (not shown) under predetermined pressure. The individual cylinders 1 through 4 of the engine 1 are provided with ignition plugs 6A, 6B, 6C and 6D, respectively. The exhaust passage 3 is connected via a branched exhaust manifold tube 3*a* to the individual cylinders 1 through 4 of the engine 1.

Outside air is supplied via the air-intake passage 2 to the engine 1 from the air cleaner 4. Fuel is injected to the vicinity of the intake manifold tube 2*a* from the individual injectors 5A to 5D to the combustion chambers of the individual cylinders 1 through 4. The supplied fuel air mixture is exploded and burnt by the ignition plugs 6A to 6D in the combustion chambers to provide the engine's driving power. After the fuel air combustion, exhaust gases are fed through exhaust passage 3, purified by the catalytic converter 7, and discharged into the atmosphere.

Figure 2:
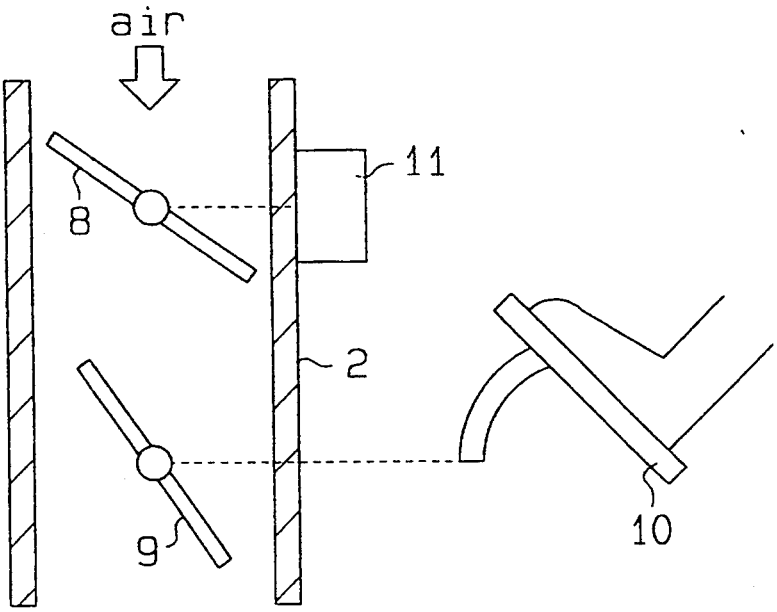
Figure 3:
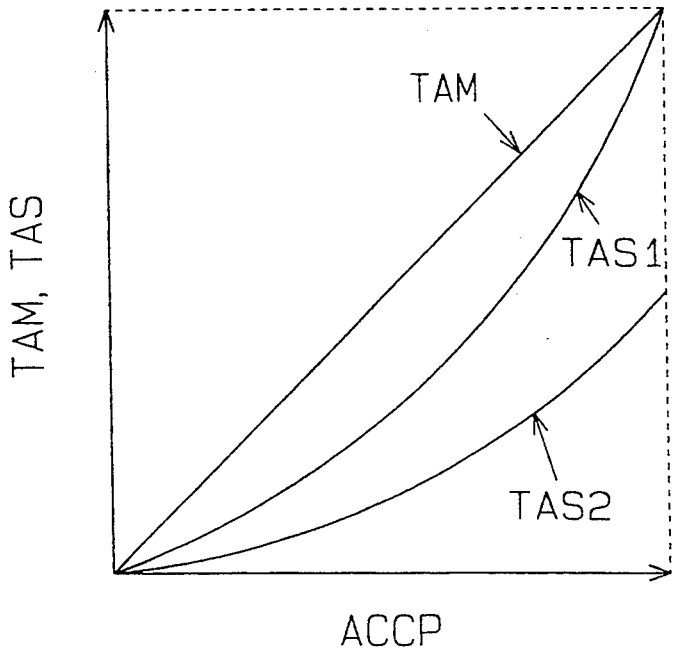

As shown in FIGS. 1 and 2, a subthrottle valve 8 and a main throttle valve 9 are disposed in series in the air-intake passage 2, with the valve 8 being located upstream of the valve 9. The subthrottle valve 8 is a linkless type, and the main throttle valve 9 is mechanically coupled via an acceleration link to an acceleration pedal 10. Accordingly throttle valve 9 is directly controlled by the manipulation of the pedal 10. The valve 9 is continuously urged closed by a return spring (no shown). FIG. 3 graphically illustrates the angle characteristics of the valve 9 or main throttle angle TAM in this embodiment. As the graph shows, the main throttle angle TAM exhibits a linear relationship with respect to the amount of the manipulation of the pedal 10, i.e., the acceleration pedal angle ACCP.

The subthrottle valve 8 is closed by a step motor 11 provided near the valve 8. The support shaft of the valve 8 is coupled to the drive shaft of the step motor 11. The valve 8 is always urged open b a return spring (not shown). FIG. 3 also shows the characteristics of the angle of the valve 8 or subthrottle angle TAS in this embodiment. The subthrottle angle TAS exhibits two nonlinear characteristics (TAS1, TAS2) with respect to the acceleration pedal angle ACCP: one for a road surface having a high frictional coefficient and the other for a road surface having a low frictional coefficient. Depending on the driving conditions, one of the two non-linear characteristics would be selected as the model for controlling the throttle valve system. Nonlinear characteristic TAS1 would be selected by the second ECU 52 to improve the vehicle's acceleration control on roads where the vehicle 30 experiences good traction. Non-linear characteristic TAS2 would be selected by ECU 52 to improve the vehicle's acceleration control on roads where the vehicle 30 experiences poor traction control.

Two advantages result from the throttle design according to the present embodiment. First, due to the mechanical independence of valve 8 from valve 9, there is less reliance placed on main throttle valve 9 for controlling air intake. Should valve 9 fail, valve 8 would be capable of regulating the supply of air to the engine. Second, since ECU 52 selectively adjust valves 8 and 9 based on nonlinear characteristics TAS1 and TAS2, the engine and vehicle are capable of maintaining optimum drivability and control characteristics. Consequently, engine power is also capable of being maintained at optimum levels. Moreover, due to the use of the double-valve throttle, if the subthrottle valve 8 fails for some reason, the main throttle valve 9 may be closed by returning the pedal 10 to it's resting position. This allows for the immediate and controlled deceleration of the engine 1 should the driver prefer. Conversely, should the subthrottle valve 8 fail when fully opened, the main throttle valve 9 may be opened by the driver's manipulation of the pedal 10. It is in this manner possible to selectively control the engineer's speed, and consequently, the engine's power. When the controller fails therefore, the driver can easily move the vehicle 30 to the shoulder of the road or the like.

To achieve these advantages, a main throttle sensor 31 is located proximate to main throttle valve 9 to detect the main throttle angle TAM. A sub throttle sensor 32 is provided in the vicinity of subthrottle valve 8 to detect the subthrottle angle TAS. An acceleration pedal sensor 33, located near acceleration pedal 10 detects the acceleration pedal angle ACCP. Engine manifold pressure PM is detected by a manifold pressure sensor 34, provided downstream of the main throttle valve 9. Disposed in the midway of the exhaust passage 3 is an oxygen sensor 35 which detects the density of oxygen, Ox, in the exhaust gas i.e., the air-fuel ratio in the exhaust passage 3. The engine 1 also utilizes a coolant temperature sensor 36 for detecting the temperature of the coolant, THW.

High voltage ignition signals are supplied to the individual ignition plugs 6A to 6D, via an igniter 13, to a distributor 12 at a timing intervals determined by the engine's crank angle. The distributor 12 utilizes an engine sensor 37 that detects the number of revolutions of the engine 1 or the engine speed NE based on the rotation of a timing rotor (not shown). The distributor 12 also has a timing sensor 38 that can detect a change in the crank angle of the engine 1 in accordance with the rotation of the timing rotor. Accordingly, in this embodiment the crankshaft makes two complete revolutions during one cycle of the engine 1. That is, for every combustion cycle, the engine completes a suction stroke, compression stroke, expansion stroke and exhaust stroke. In effect, the timing sensor 38 detects the crank angle every 360°.

The drive train of vehicle 30 in the present embodiment may be, but is not limited to a pair of rear driving wheels 14L and 14R and a pair of front wheels 15L and 15R. The crankshaft of the engine 1 is coupled to an automatic transmission 16 that, in turn, is coupled to the driving wheels 14L and 14R via a drive shaft 17, a differential gear 18 and a pair of drive axles 19L and 19R. The automatic transmission 16 is electronically controlled in this embodiment by means of an actuator **16*a*, which includes a lockup mechanism, four front speed change gears, a rear speed gear, and a plurality of solenoids between the lockup mechanism and the speed change gears. In this embodiment, the driving wheels 14L and 14R are provided with driving-wheel speed sensors 39L and 39R, that detect the rotational speeds of the driving wheels (VWNRL) 14L and (VWNRR) 14R. The front wheels 15L and 15R are provided with front-wheel speed sensors 40L and 40R that detect the rotational speeds of the front wheels (VWNFL) 15L and (VWNFR) 15R. Each sensor 39L, 39R, 40L and 40R utilize a gear 20 and a pickup coil 21**.

In this embodiment, the automatic transmission 16 is provided with a vehicle speed sensor 41 which detects the speed (velocity) SPD of the vehicle 30. This sensor 41 utilizes a magnet (not shown) that rotates with the rotation of the currently selected gear of the automatic transmission 16. A reed switch (not shown) is activated by the magneto output of a pulse signal corresponding to the vehicle speed SPD. The sensors 31 to 38 and 41 as well as the injectors 5A to 5D, igniter 13 and actuator **16*a*, the ECU 51 properly controls the components 5A to 5D, 13 and 16*a*** to perform fuel injection control, ignition timing control, and automatic transmission control.

While the first ECU 51 performs various controls, the second ECU 52 is provided to control the subthrottle valve 8. The second ECU 52 is connected to the first ECU 51 to exchange signals with the ECU 51. Similarly, the speed sensors 39L, 39R, 40L and 40R and the step motor 11 are connected to the second ECU 52. Of the various signals input to the first ECU 51 necessary to control the subthrottle 8, the signals TAM, TAS, ACCP, PM, NE and SPD are sent to the second ECU 52 from the first ECU 51. The second ECU 52 also receives signals associated with various parameters, VWNRL, VWNRR, VWNFL and VWNFR, from the speed sensors 39L, 39R, 40L and 40R. Based on these input signals, the second ECU 52 properly controls the step motor 11, which in turn controls the subthrottle valve 8. In this way,, ECU 52 is able to control subthrottle 8 despite the occurrence of various operating conditions.

Figure 4:
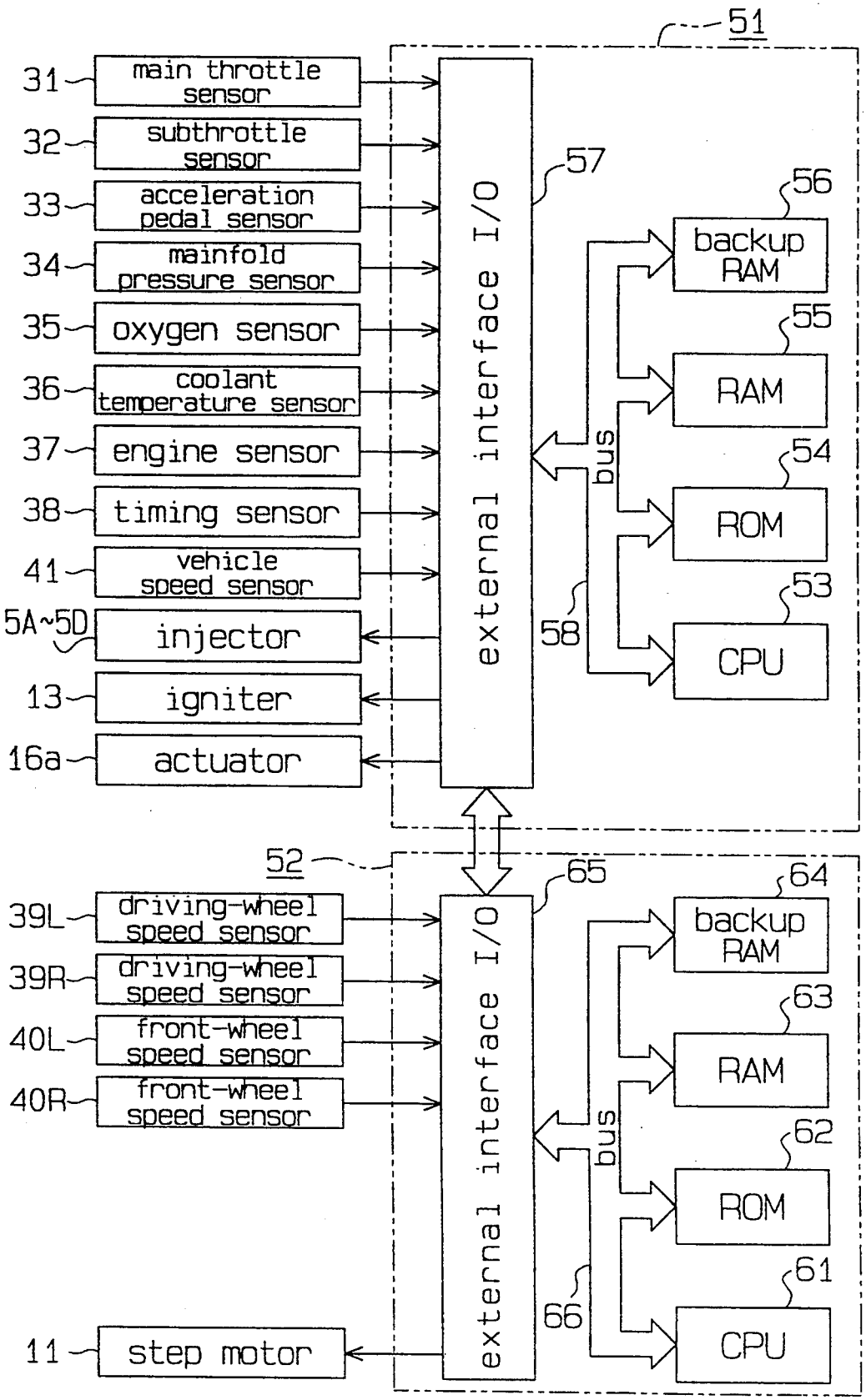

FIG. 4 presents a block diagram of the electric structure of this embodiment. The first ECU 51 comprises a central processing unit (CPU) 53, a read only memory (ROM) 54, a random access memory (RAM) 55 and a backup RAM 56. The ECU 51 is designed as a logical operation circuit with components 53 to 56 connected to an external input/output (I/O) interface circuit 57 via a bus 58. A counter function is incorporated into the CPU 53 and provides the necessary timing to execute control programs stored in the ROM 54. The RAM 55 temporarily stores the results of operations executed by the CPU 53, while the backup RAM 56 retains previously-stored data. The external I/O interface circuit 57 is provided with signals from individual sensors 31 to 38 and 41. The external I/O interface circuit 57 is also coupled to the injectors 5A to 5D, igniter 13, actuator 16*a*, as well as to the second ECU 52.

The CPU 53 receives signals from the various sensors 31 to 38 and 41 via the external I/O interface circuit 57 as input values. Based on these input values and the control programs stored in the ROM 54, the CPU 53 performs the fuel injection control, ignition timing control, automatic transmission control and so forth. In addition, the CPU 53 executes a fuel modulation routine if and when the throttle control system fails. Of the various signals provided by the external I/O interface circuit 57, the signals necessary for the subthrottle control are output to the second ECU 52.

The second ECU 52 Has the same basic structure as the first ECU 51: a CPU 61, a ROM 62, a RAM 63, a backup RAM, 64, an external I/O interface 65 and a bus 66. The external I/O interface circuit 65 is coupled to the individual speed sensors 39L, 39R, 40L, 40R, and the step motor 11. Predetermined control programs and other necessary data for the subthrottle control, etc. are previously stored in the ROM 62. The CPU 61 receives input signals from the speed sensors 39L, 39R, 40L and 40R via the external I/O interface circuit 65 and various signals from ECU 51. Based on those input values and the control programs stored in the ROM 62, the CPU 61 properly controls the step motor 11. In order to provide an adequate control response in the event of a failure in the throttle control system, the ECU 51 executes a fuel modulation routine based on the various input signals. The throttle control system includes the subthrottle valve 8, the step motor 11, the subthrottle sensor 32, the acceleration pedal sensor 33, and a second ECU 52. Thus should any single or multiple components of the throttle control system fail, ECU 51 by means of the fuel modulation routine controls the supply of fuel to the engine. The fuel cutting routine in part accomplishes this by setting a high and low engine speed values FRT and FNE respectively, that defines a range of engine speeds approximating that of the engine speed NE prior to the detected throttle malfunction. Should the engine speed level approach the lower engine speed value FRT, the ECU 51 controls a fuel moderating means, such as fuel injectors 5A through 5D, to supply fuel to the engine. Should the engine speed level approach the higher engine speed value, the ECU 51 controls the fuel injectors 5A through 5D to cut the supply of fuel to the engine. These two routines, i.e., fuel supply and fuel cutting are simultaneously executed by ECU 51, and operate to modulate the supply of fuel to the engine. Consequently, the application of these two routines to control fuel or power moderating means, such as fuel injectors, effectively modulates engine speed and regulates the engine power at times when ECU 51 detects the occurrence of a throttle valve system failure. This fuel modulation routine, will now be described with reference to flowcharts shown in FIGS. 5 through 7.

Figure 7:
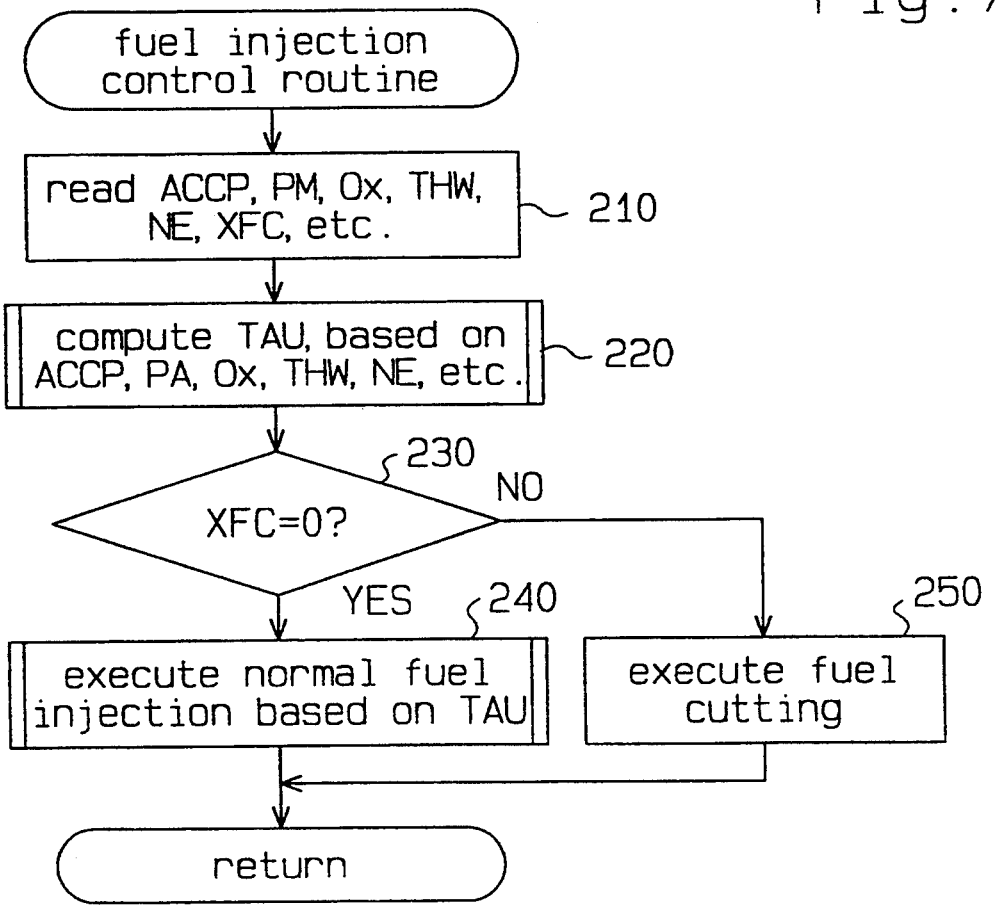

The flowchart illustrated in FIG. 7 describes the "fuel injection control routine" executed by the first ECU 51 for each period of the fuel modulation routine, during periods of throttle malfunction, and for those times when the ECU 51 detects no throttle malfunction. The execution of the fuel supply routine depends in part on the setting of a fuel cutting execution flag XFC by the fuel cutting routine. When the fuel cutting routine detects the occurrence of a failure, and when engine speed exceeds the high engine speed value set as a limit to the range of modulated engine speeds, the ECU 51 set a fuel cutting flag XFC high. This signals the ECU 51 to control the fuel injectors 5A through 5D to cut the supply of fuel to the engine 1. The fuel supply routine uses the flag XFC to determine whether to call or execute the fuel cutting routine. Thus, both routines, the fuel cutting and fuel supply are simultaneously executed by ECU 51 to accomplish engine fuel supply, engine speed and power modulation. At the initialization of the fuel supply routine, the ECU 51 obtains the values of various parameters ACCP, PM, Ox, THW and NE from the signals from the individual sensors 33–37, etc. in step 210. The ECU 51 also reads the value of the fuel cutting execution flag XFC set by the above described "fuel cutting routine".

At the next step 220, the ECU 51 computes a target amount of fuel to be injected, TAU, according to the current driving conditions of the engine 1, based on the currently read various parameters ACCP, PM, Ox, THW and NE. The ECU 51 then at step 230 determines whether or not the current read fuel cutting execution flag XFC is "0". When the flag XFC is "0", the ECU 51 goes to step 240 to execute the normal fuel injection. At step 240, the ECU 51 opens the individual injectors 5A to 5D based on the target injection amount TAU, fuel injection is carried out and ECU 51 temporarily terminates the routine and begins a new fuel injection routine. Should, however, the fuel cutting execution flag XFC be determined to be "1" at step 230, the ECU 51 considers that the fuel cutting has been requested and proceeds to step 250 where the ECU 51 causes the injectors 5A–5D to close and terminates the subsequent process.

Figure 5:
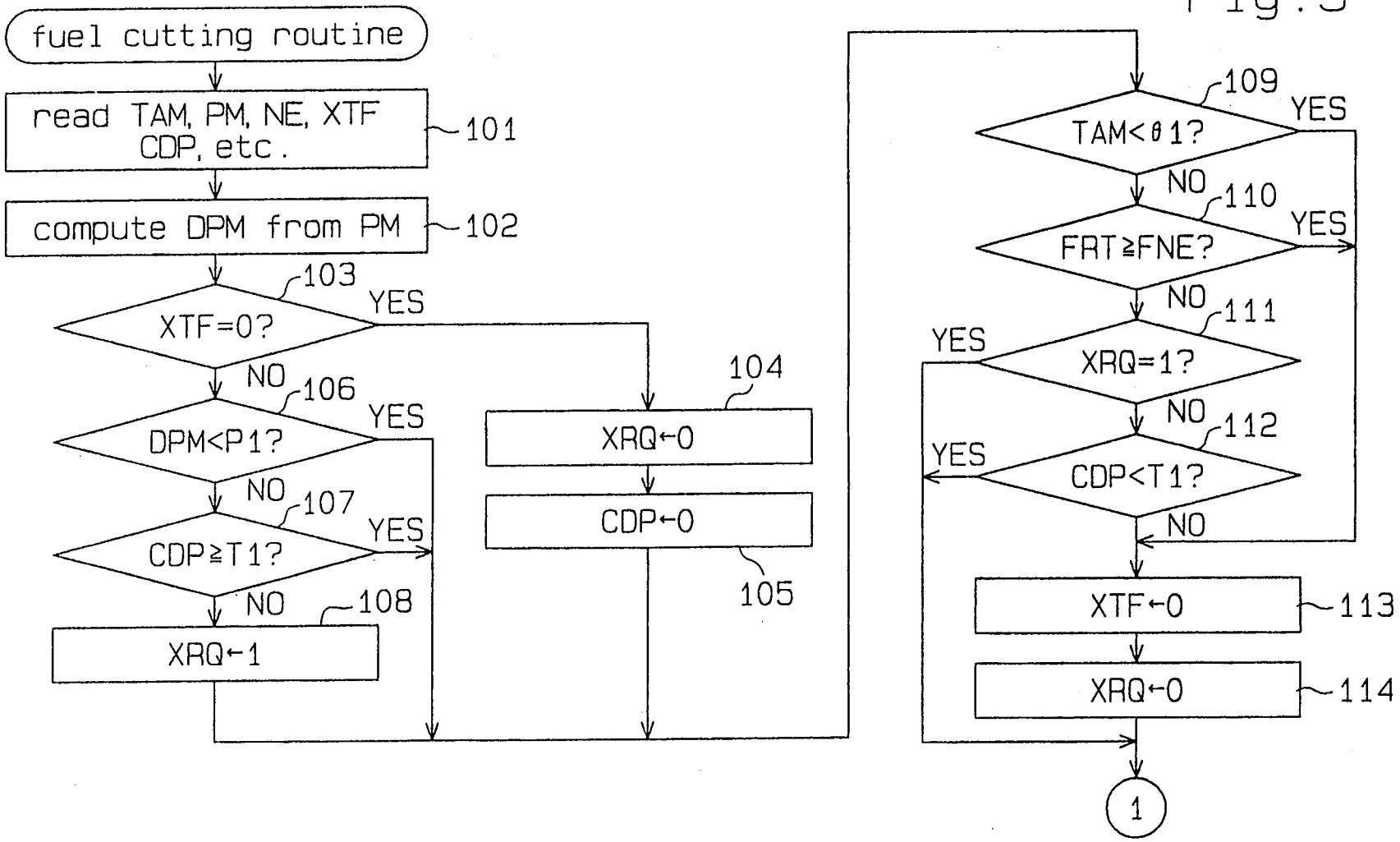
Figure 6:
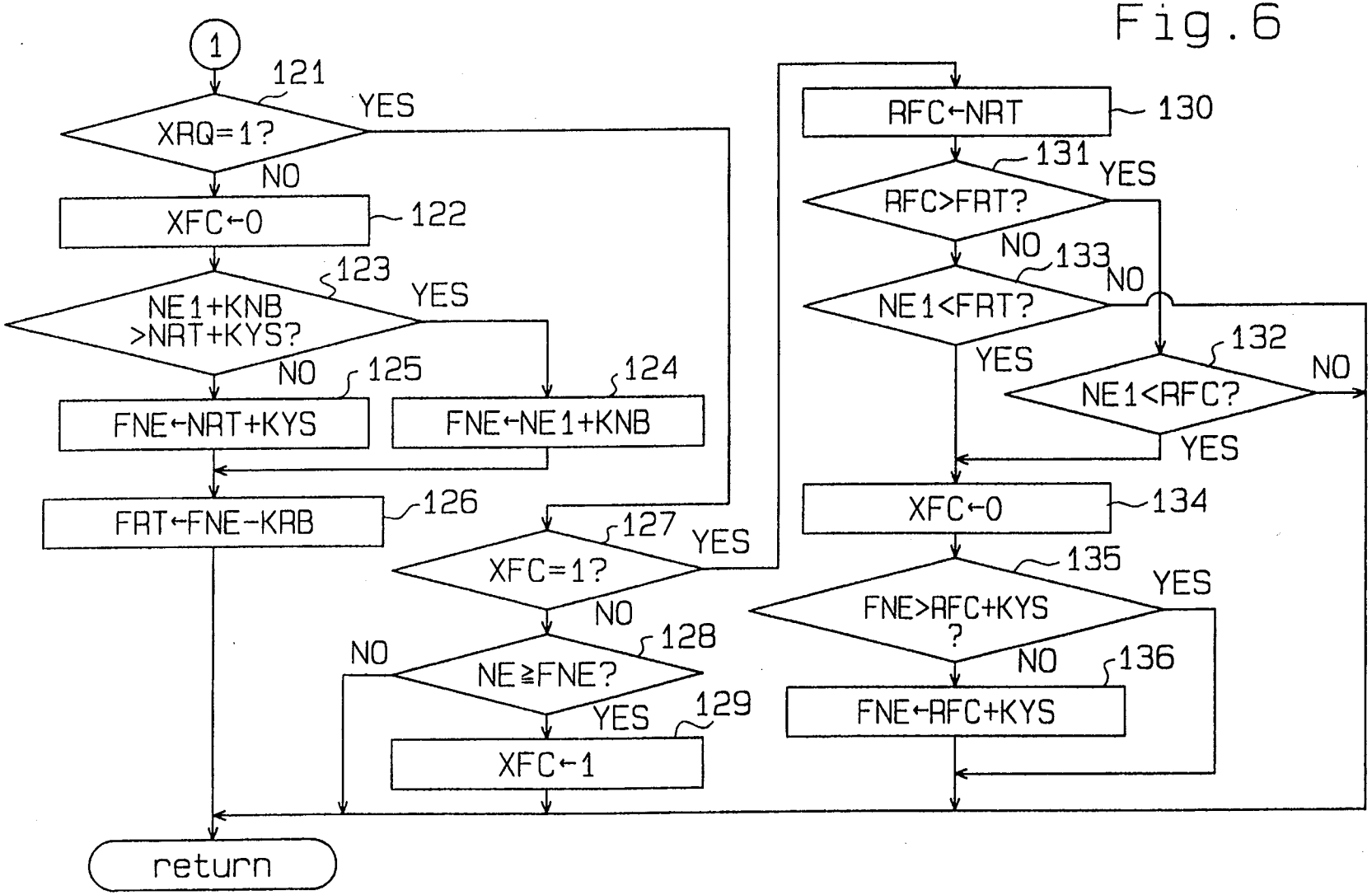

FIGS. 5 and 6 are flowcharts illustrating a fuel cutting routine that is executed by the first ECU 51. At the beginning of the routine, the ECU 51 first at step 101, obtains the main throttle angle TAM, manifold pressure PM, engine speed NE, etc. from the signals provided by the individual sensors 31, 34, 35, etc. During this process, the ECU 51 also reads a failure flag XTF and a throttle response time CDP for the manifold pressure PM, both of which are associated with the subthrottle control. When the failure flag XTF, preset in another subroutine gets set to "1", it indicates that a malfunction in the throttle control system has been detected. This happens, for example, when the main throttle angle TAM is equal to or greater than a predetermined value $\theta 1$ and when the change in subthrottle angle TAS per unit time, DTS, is equal to or greater than $\theta 2$. The throttle response time CDP is measured in a similar fashion in another subroutine. Time CDP represents the time lag from when the throttle undergoes a position change DTS to when the manifold pressure PM changes in response.

The ECU 51 calculates the rate of change in manifold pressure PM per unit time, DPM in step 102. Rate DPM is obtained from the difference between the value of the currently read manifold pressure PM and the previously read manifold pressure PM. At step 103, the ECU 51 determines whether or not the subthrottle failure flag XTF is set to "0". When the value of this flag XTF is "0", the ECU 51 considers that no failure of the throttle control system has been detected and proceeds to step 104. At step 104, the ECU 51 sets the fuel-cut request flag XRQ to "0". This request flag XRQ is used as an indication that the fuel cutting routine has been called to intermittently cut and supply the fuel supply to the engine 1. At the next step 105, the ECU 51 resets the throttle response time CDP to "0" and proceeds to step 109.

When the control failure flag XTF is "1" in step 103, the ECU 51 considers that a failure of the throttle control system has been detected and moves to step 106. At this step 106, the ECU 51 determines whether or not the rate of change in the manifold pressure DPM is less than a predetermined value P1. When DPM is less than the predetermined value P1, the ECU 51 recognizes the change in engine power is small and proceeds to step 109. When the speed change DPM is equal to or greater than the predetermined value P1, the ECU 51 recognizes that the change in engine power is large and proceeds to step 107.

At step 107, the ECU 51 determines whether or not the throttle response time CDP is equal to or greater than a predetermined value T1. When time CDP is equal to or greater than a predetermined value T1, the ECU 51 determines that engine power has not significantly changed and proceeds to step 109. When the throttle response time CDP is smaller than the predetermined value T1, the ECU 51 considers that the engine power has significantly changed and moves to step 108.

At step 108, the ECU 51 sets the request flag XRQ to "1" to request intermittent fuel cutting and fuel supply. Next at step 109, from an of the steps 105 to 108, the ECU 51 determines whether r not the current main throttle angle TAM is less than the predetermined value $\theta 1$. If it is, the ECU 51 proceeds to step 113. On the other hand, when the throttle angle TAM is equal o or greater than the predetermined value $\theta 1$, the ECU 51 advances to step 110.

The ECU 51, at step 110 determines whether or not the fuel supply engine speed FRT, at the end of a fuel modulation period upon the resumption of normal fuel supply, is equal to or greater than the fuel cut engine speed FNE at the beginning of a fuel modulation period when fuel cutting begins. When the fuel supply engine speed FRT is equal to or greater than the fuel cut engine speed FNE in step 110, the ECU 51 moves to step 113. When the fuel supply engine speed FRT is less than the fuel cut engine speed FNE, the ECU 51 proceeds to execute the routine at step 111. There, the ECU 51 determines whether the request flag XRQ is "1". When this flag XRQ is "1", the ECU 51 considers that the fuel modulation routine has been requested, and moves to step 121. When this flag XRQ is "0", the ECU 51 proceeds to step 112 for confirmation.

At step 112, the ECU 51 determines whether or not the throttle response time CDP is less than the predetermined value T1. When time CDP is smaller than the predetermined value T1, the ECU 51 considers that the engine power has significantly changed and that the fuel cutting routine has been requested, and moves to step 121. When this time CDP is equal to or greater than the predetermined value T1, the ECU 51 moves to step 113.

At step 113, following any of the steps 109, 110 and 112, the ECU 51 determines that the throttle control system has not malfunctioned, and sets the control failure flag XTF to "0". At the subsequent step 114, the ECU 51 considers that no intermittent fuel cut is necessary and sets the request flag XRQ to "0". Proceeding from steps 111, 112 or 114, the ECU 51 determines, at step 121, whether or not the request flag XRQ is "1". When this flag XRQ is "0", the ECU 51 considers that the throttle control system is normal and that no intermittent fuel cut has been requested. At step 122, the ECU 51 sets an fuel cutting execution flag XFC to "0" to interrupt the fuel cutting procedure. Next, at step 123, the ECU 51 adds the currently read engine speed NE1 and an offset value KNB . The ECU 51 then compares the sum of NE1 and KNB with the sum of lower limit engine speed NRT and a minimum engine speed range KYS. ECU 51 then determines whether the currently read and offset engine speed NE1 is larger than the lower limit offset engine speed value NRT plus KYS. The lower limit engine speed NRT is set in accordance with a load in the air conditioner mounted in the vehicle 30, a load in the electric equipment, etc. Speed NRT represents the minimum engine speed value which can be maintained during a fuel modulation period without causing the engine to stall. The minimum value of the engine speed NE is used in conjunction with preset value KNB to derive an upper engine speed value FNE for the fuel cutting routine. Preset value KRB is the largest engine speed range permitted by the fuel cutting routine. Value KRB, offset by value KNB, is used to establish a lower limit of the engine speed during the fuel cutting routine. Preset value KYS is the smallest engine speed range used during the fuel cutting routine that will still permit the driver to feel the effect of the modulation. The minimum engine speed range KYS is set in order that the engine 1 exhibits a pulsating behavior when the fuel cutting routine is executed.

At step 123, when the sum of parameters NE1 and KNB is larger than the sum of both parameters NRT and KYS, the ECU 51 proceeds to step 124. The ECU 51, at step 124 sets the sum of the parameters NE1 and KNB as the fuel cut engine speed FNE. Should the sum of the parameters NE1 and KNB, as determined at step 123, be equal to or smaller than the sum of parameters NRT and KYS, the ECU 51 proceeds to step 125. There, the ECU 51 sets the sum of parameters NRT and KYS as the fuel cut engine speed FNE. Next at step 126, following the step 124 or 125, the ECU 51 subtracts an offset value KRB from the currently et fuel cut engine speed FNE. The ECU 51 sets the resultant value as the fuel supply engine speed FRT, and temporarily terminates the current cutting routine and begins a new routine.

Should the request flag XRQ be set to "1" at step 121, the ECU 51 recognizes that he throttle control system has failed, and then proceeds to execute the processes at steps 127 through 136. At step 127, the ECU 51 determines whether or not the fuel cutting execution flag XFC is "1". When the flag XFC is "0", the ECU 51 determines that normal fuel injection has resumed and advances to step 128. Next at step 128, the ECU 51 determines whether or not the current engine speed NE1 is equal to or greater than the currently set fuel cut engine speed FNE. When the engine speed NE1 is smaller than the fuel cut engine speed FNE, the ECU 51 temporarily terminates the current cutting routine and resumes a normal fuel injection. When the engine speed NE1 is equal to or above the fuel cut engine speed FNE, the ECU 51 proceeds to step 129 to start the fuel cutting. At this step 129 the ECU 51 sets the fuel cutting execution flag XFC to "1", temporarily terminates the current cutting routine and begins a new routine. On the other hand, when the fuel cutting execution flag XFC is "1" at step 127, the ECU 51 considers that the fuel cutting has already occurred and goes to step 130 where the ECU 51 sets the current lower limit engine speed NRT in memory as variable value RFC.

At the next step 131, the ECU 51 determines whether or not the variable RFC as set in memory is larger than the current fuel supply engine speed FRT. When variable value RFC is larger than the fuel supply engine speed FRT, the ECU 51 proceeds to step 132. When variable value RFC is equal to or smaller than the fuel supply engine speed FRT, the ECU 51 proceeds to step 133. At step 132, the ECU 51 determines whether or not the current engine speed NE1 is smaller than the variable value RFC. When the engine speed NE1 is smaller than the variable value RFC, the ECU 51 executes the procedure at step 134 and sets the fuel cutting execution flag XFC to zero. When the engine speed NE1 is equal to or above the variable value RFC, the ECU 51 temporarily terminates the fuel cutting process, resumes fuel injection and begins a new routine.

At step 133 following step 131, the ECU 51 determines whether or not the current engine speed NE1 is smaller than the fuel supply engine speed FRT. When the engine speed NE1 is smaller than the fuel supply engine speed FRT, the ECU 51 moves to step 134 where it sets the fuel cutting execution flag to zero. When the engine speed NE1 is equal to or above the fuel supply engine speed FRT, the ECU 51 temporarily terminates the current fuel cutting process, resumes fuel injection and begins a new routine.

Proceeding from either step 132 or step 133, the ECU 51 next at step 134 sets tile fuel cutting execution flag XFC to "0" to finish the fuel cutting and resumes normal fuel injection by executing the fuel injection control routine. At the next step 135, the ECU 51 determines whether or not the fuel cut engine speed FNE is larger than the sum of the variable value RFC and the minimum engine speed range KYS. When the fuel cut engine speed FNE is larger than the RFC plus KYS, the ECU 51 temporarily terminates the current cutting routine without altering the value of the fuel cut start engine speed FNE. When the fuel cut engine speed FNE is equal to or smaller than the variable value RFC plus the minimum engine speed range KYS, the ECU 51 moves to step 136. There, the ECU 51 adds the variable value RFC and minimum engine speed range KYS, sets the resultant sum as a new fuel cut engine speed FNE, temporarily terminates the current fuel cutting process, resumes normal fuel injection via the fuel injection control routine, and begins a new fuel cutting routine.

Because the lower limit engine speed NRT may have changed since the setting of either the fuel cut start engine speed FNE or the fuel supply engine speed FRT, the fuel cut engine speed FNE is confirmed in steps 135 and 136. The fuel cut engine speed FNE is always set larger than the lower limit engine speed NRT.

The calculation for the fuel cutting routine is executed in the above manner. When the throttle control system fails, the fuel cutting execution flag XFC that is used in the "fuel injection control routine" discussed above, is set to "0" or "1" to execute the intermittent fuel cutting and normal fuel injection according to both the fuel cutting and fuel supply routines. Since this modulation is performed based on with the engine speed immediately before the occurrence of a failure, engine speeds FNE, FRT, NRT and other engine speed parameters are set to maintain the engine speed, and consequently vehicle speed, at a level occurring just prior to the detected throttle valve system failure. Due to the direct relationship between engine speed and engine power, engine power is also regulated by the above described fuel supply modulation. The above described fuel modulation will now be graphically described with reference to FIGS. 8 to 11. These figures illustrate the relationship among various computed engine speed parameters, such as the engine speed NE, fuel cut engine speed FNE, fuel supply engine speed FRT, and lower limit engine speed NRT, set by the ECU 51 during the fuel cutting and supply routines.

Figure 8:
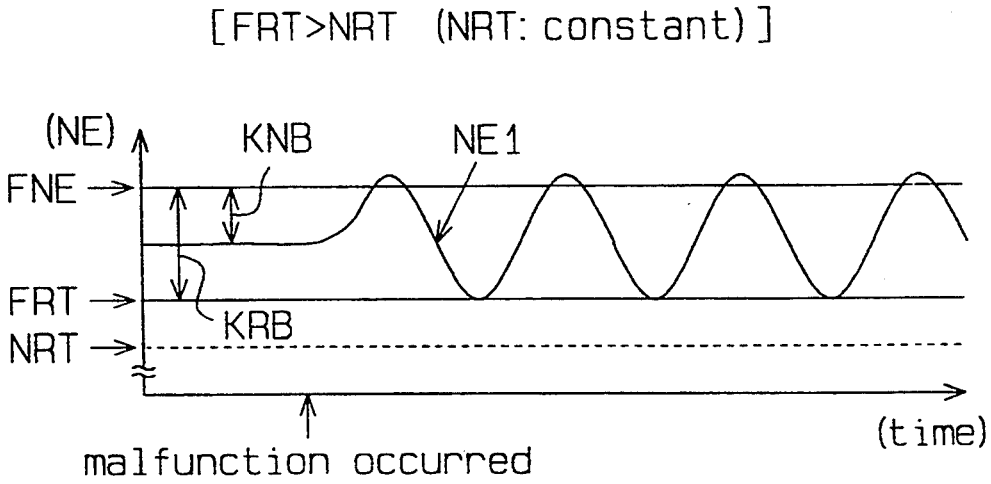

FIG. 8 shows the case where the fuel supply engine speed FRT is higher than the constant lower limit engine speed NRT. When ECU 51 determines the existence of a failure in the throttle control system, the fuel cut engine speed FNE is set as a reference value at the time of the failure. The fuel supply engine speed FRT is lower than fuel cut engine speed FNE by offset value KRB, and gets set as a reference value at the failure time. Engine speed FNE, immediately before the occurrence of a throttle failure, is higher than the engine speed NE by offset value FNB. When the fuel supply engine speed FRT is larger than the lower limit engine speed NRT, intermittent fuel cutting and fuel supply are executed in a range between the fuel cut engine speed FNE and fuel supply engine speed FRT.

When the current engine speed NE1 increases to the fuel cut engine speed FNE, the fuel cutting starts. When the engine speed NE1 falls to the fuel supply engine speed FRT thereafter, the fuel cutting ends and the normal fuel injection resumes. When the engine speed NE1 rises again to the fuel cut engine speed FNE thereafter, the fuel cutting starts again. The control causes the engine speed NE1 to be maintained at various speeds, i.e., between the fuel cut engine speed FNE and the fuel supply engine speed FRT. This effectively modulates the engine speed and power within a range approximating that of the engine speed and power just prior to the throttle valve system malfunction.

Figure 9:
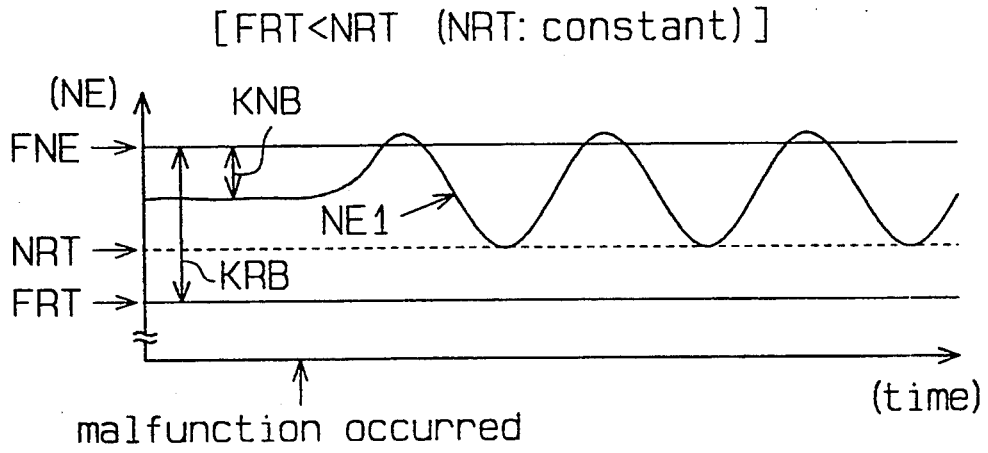

FIG. 9 illustrates all example where the fuel supply engine speed FRT is lower than the constant lower limit engine speed NRT. When the throttle control system fails in this case, the reference fuel cut engine speed FNE is offset higher than engine speed NE by preset value KNB. This occurs immediately before the occurrence of the throttle valve system failure. Since the fuel supply engine speed FRT is lower than the lower limit engine speed NRT, speed NRT is set as a lower reference value at the time of failure. The intermittent fuel cutting and fuel supply will be executed between the fuel cut engine speed FNE and lower limit engine speed NRT.

Specifically, when he current engine speed NE1 increases to the fuel cut engine speed FNE, fuel cutting starts. When the engine speed NE1 decreases to the lower limit engine speed NRT thereafter, the fuel cutting ends and the normal fuel injection resumes. When the engine speed NE1 next increases to the fuel cut engine speed FNE, the fuel cutting starts again. This control causes the engine speed NE1 to be maintained over a range of engine speeds, specifically, between the fuel cut engine speed FNE and the lower limit engine speed NRT. Both fuel cutting and normal fuel injection routines are executed in a single period of the fuel cutting routine.

Figure 10:
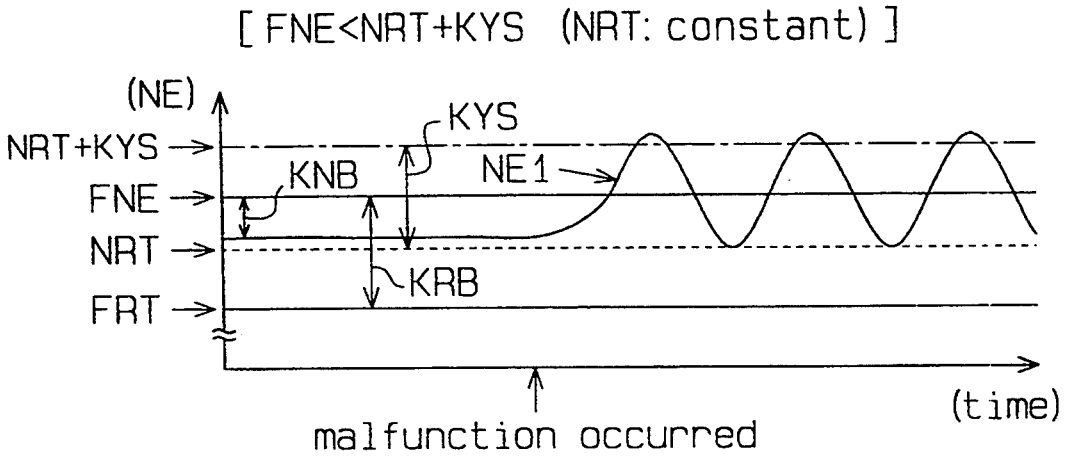

FIG. 10 shows the case where the fuel supply engine speed FRT is lower than the constant lower limit engine speed NRT. In this case, any value in the range between the fuel cut engine speed FNE and the lower limit engine speed NRT is smaller than the minimum engine speed range KYS. The routine parameter KYS defines the minimum engine speed range over which engine speed NE1 is capable of being maintained during the fuel modulation routine. Thus in this case, when the throttle control system fails, the fuel cut engine speed FNE, is set higher than the engine speed NE by offset value KNB immediately before the occurrence of the failure. The sum of the lower limit engine speed NRT the minimum engine speed range KYS (NRT+KYS) is set as a high engine speed reference value at the time of the failure, and the lower limit engine speed NRT is set as a low engine speed reference value at the time of the failure. The intermittent fuel cutting will be executed for engine speed values ranging between the first value of the sum of speeds NRT+KYS and the second value of the lower limit engine speed NRT.

When the current engine speed NE1 increases to the above mentioned first value, fuel cutting starts. When the engine speed NE1 next decreases to the lower limit engine speed NRT, the fuel cutting is terminated and the normal fuel injection resumes. This action comprises one period of the fuel modulation routine. When the engine speed NE1 once again rises to the sum of values NRT and KYS, the fuel cutting once again resumes and will be followed by a fuel supply cycle. Engine speed NE1 will thus be modulated between the sum of NRT and KYS and the lower limit engine speed NRT. Accordingly, injector control is accomplished by modulating the supply of fuel to the engine to maintain engine power as it was prior to the throttle system malfunction despite varying road conditions.

Figure 11:
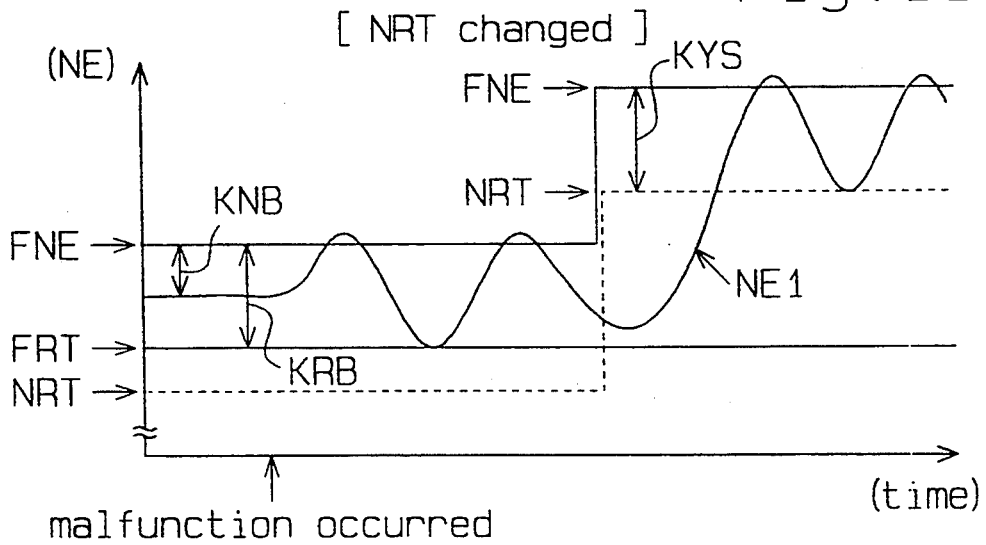
Figure 12:
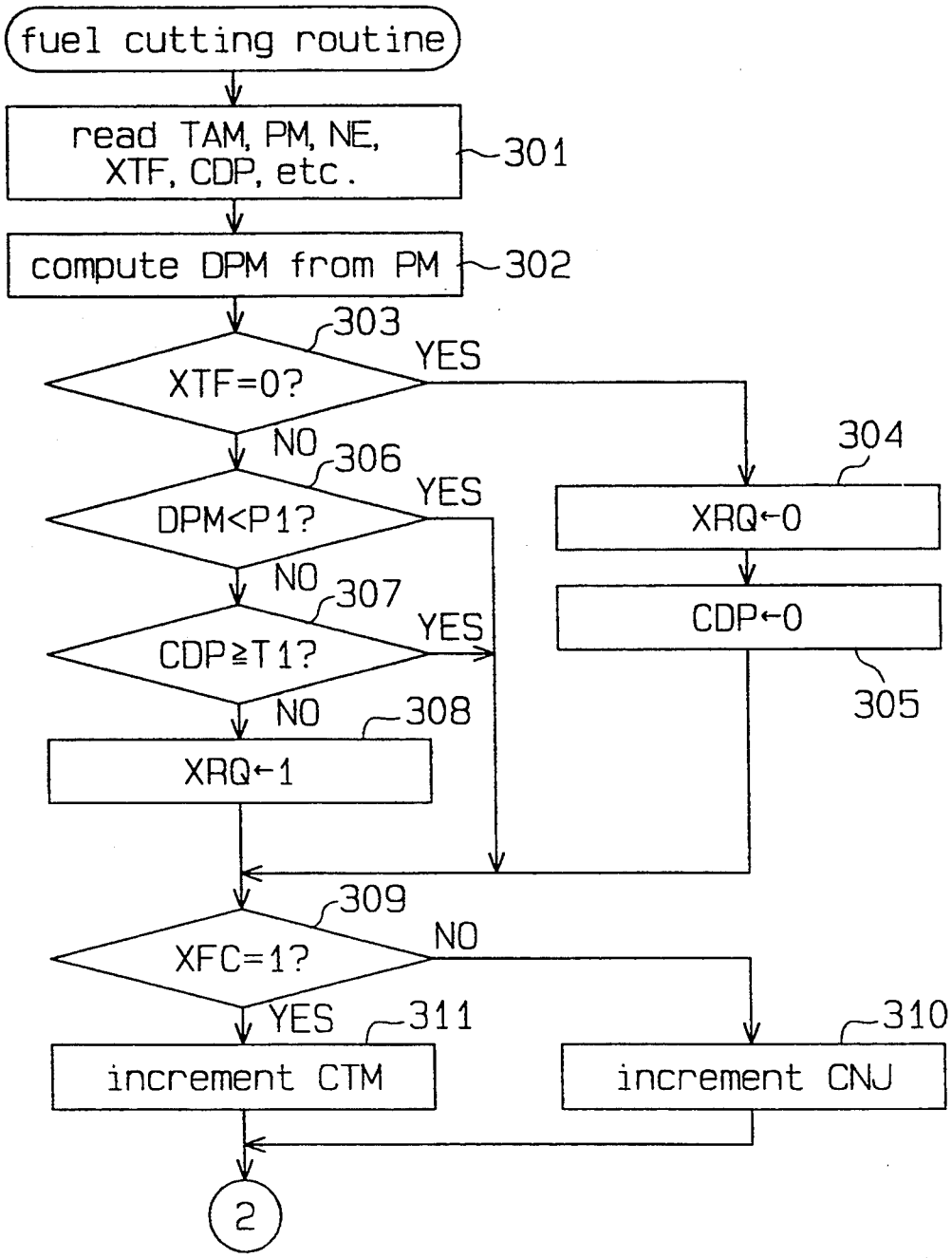
FIGS. 12 through 18 illustrate an engine power regulator according to a second embodiment of the present invention.
Figure 13:
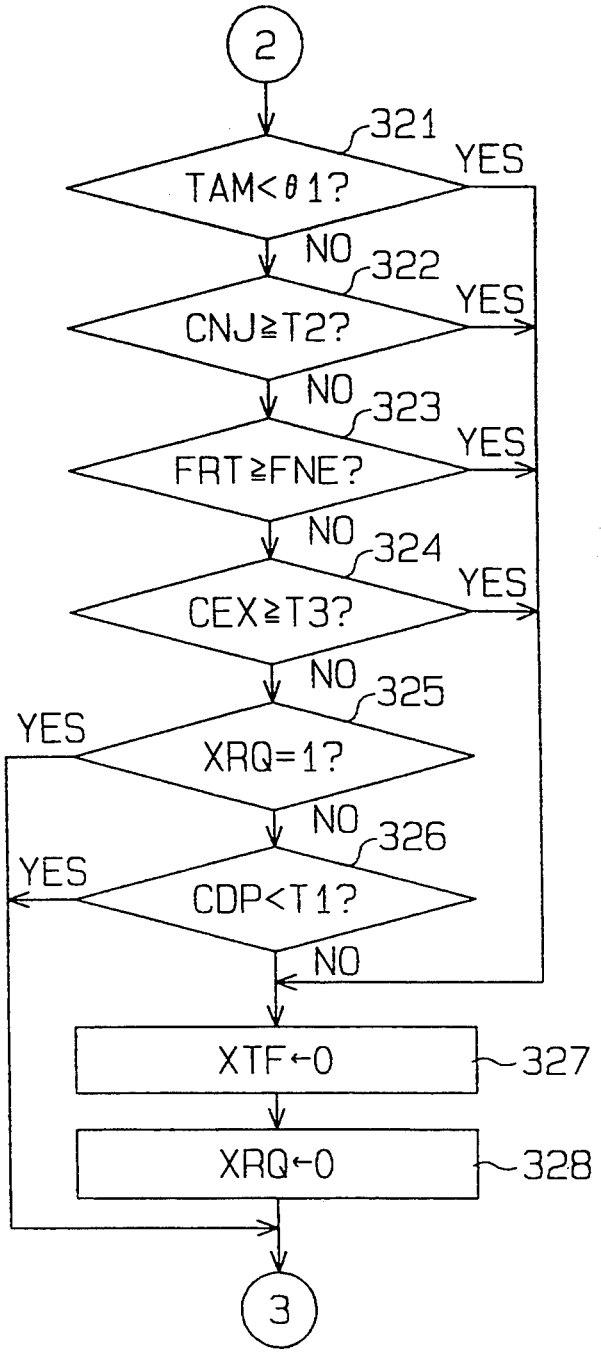
Figure 14:
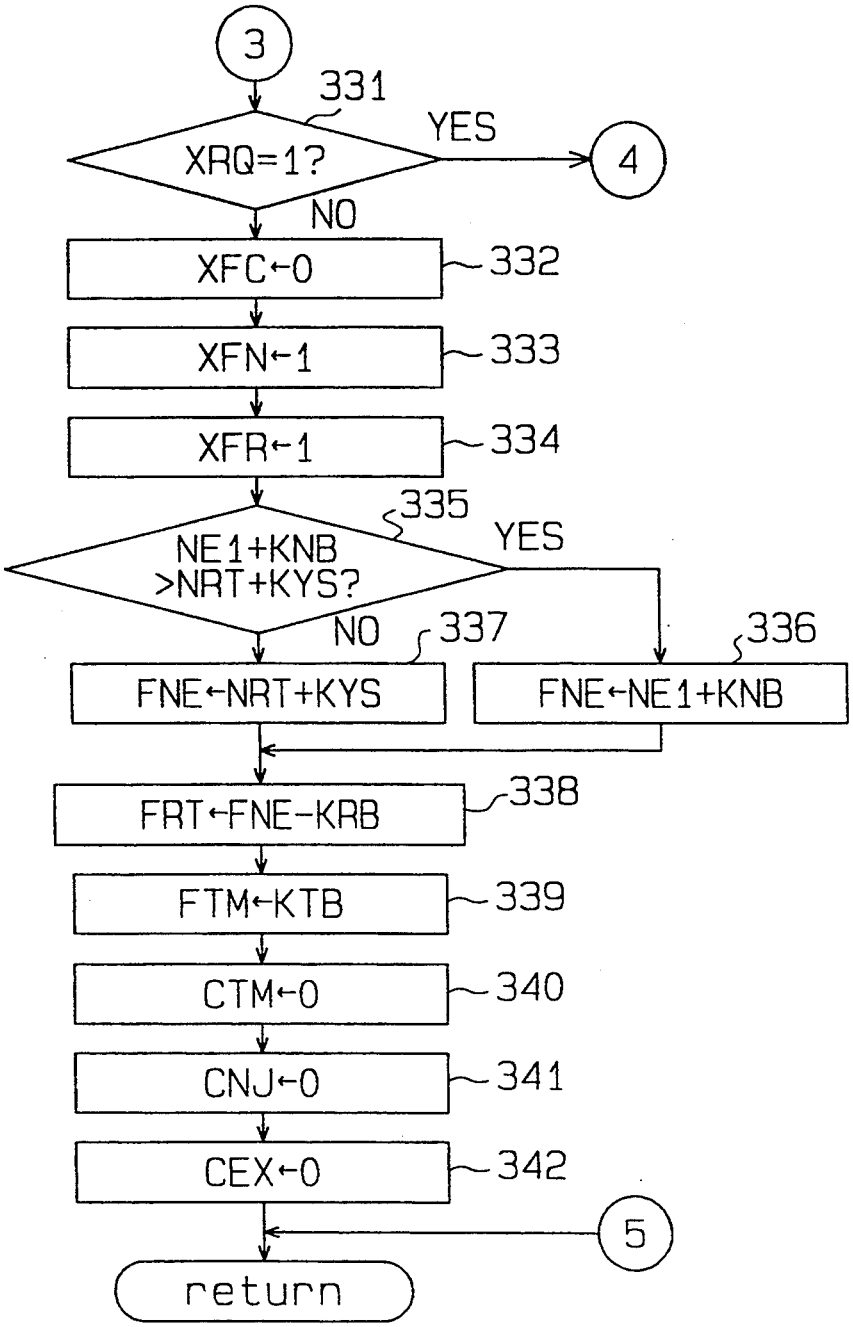
Figure 15:
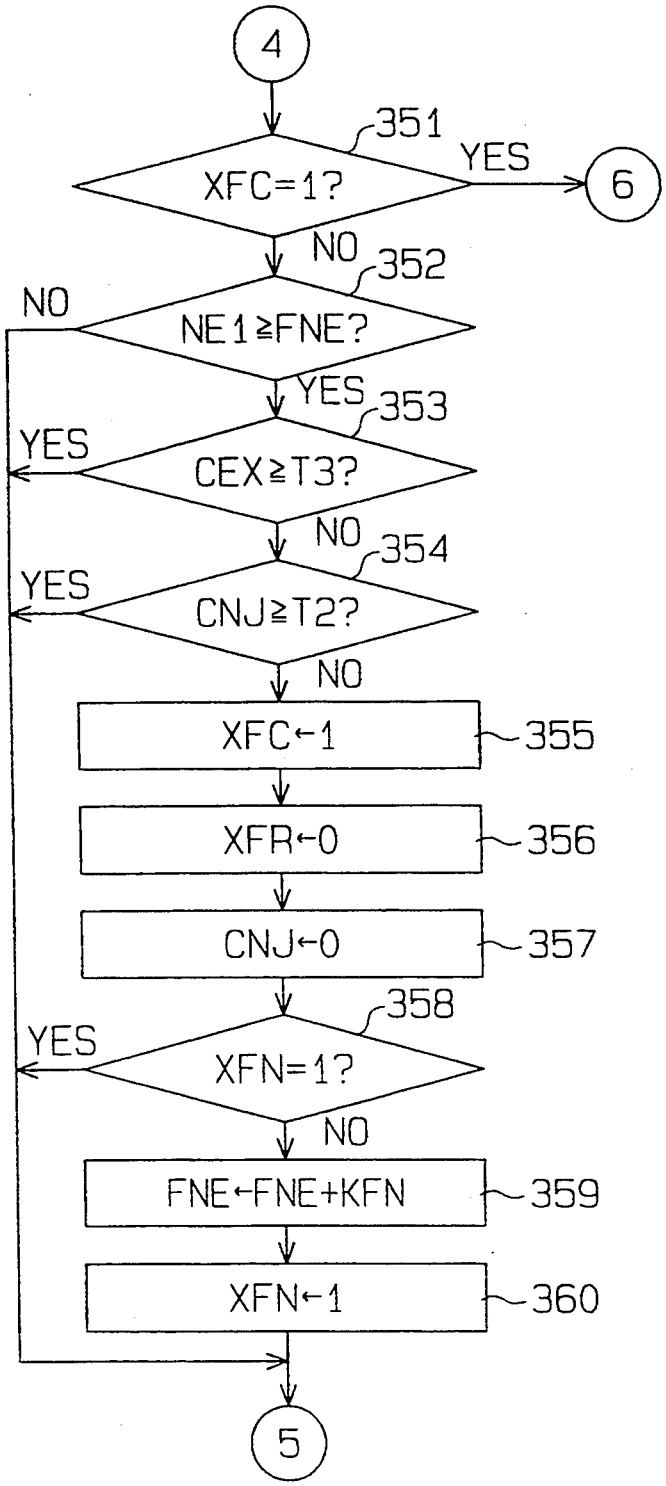
Figure 16:
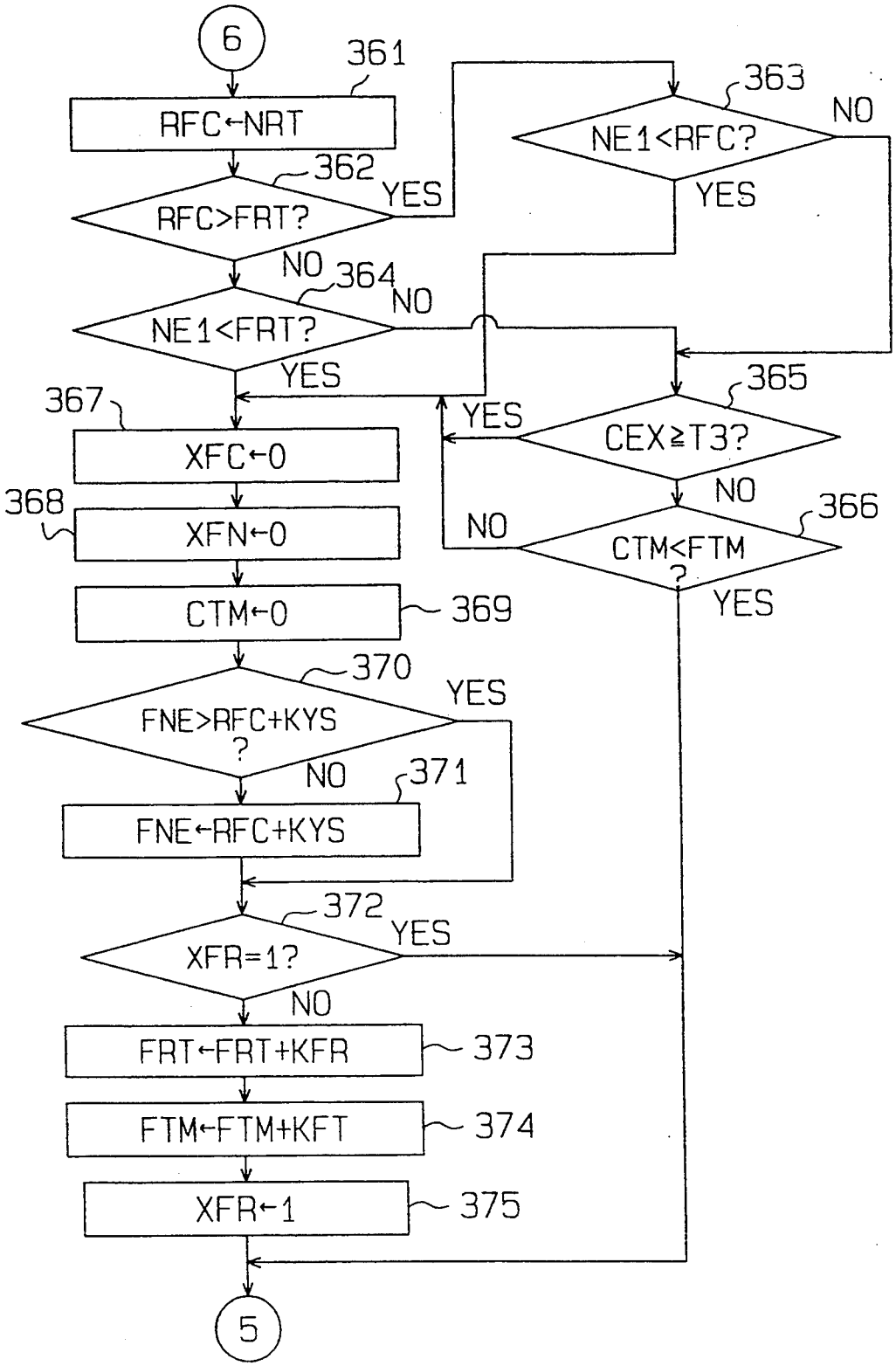

FIG. 11 shows the case where the lower limit engine speed NRT changes during the modulation routine to exceed the fuel supply engine speed FRT. This could happen due to a external load being applied to engine 1 by the operation of the vehicle's air conditioning, electric lighting or the like. When the engine has no external load at the time a throttle control system failure, the fuel cut engine speed FNE is set on the basis of the engine speed NE immediately before the occurrence of the failure. The intermittent fuel cutting and supply will be executed between the fuel cut engine speed FNE and the fuel supply engine speed FRT. Should an external load be produced thereafter, lower limit engine speed NRT is increased, and engine speed FNE is determined by offsetting speed NRT by value KYS. Intermittent fuel cutting and supply will be carried out in the range between the fuel cut engine speed FNE and the lower-limit engine speed NRT.

Throughout this control, the engine speed NE1 is variously maintained over a range of speeds between the fuel cut engine speed FNE and the fuel supply engine speed FRT or between the fuel cut engine speed FNE and the lower limit engine speed NRT, in accordance with the change in lower limit engine speed NRT. Even with the application of external loads, the engine speed NE is according to this embodiment, maintainable above a minimum value during the fuel cutting and supply procedure. Injector control is accomplished by the fuel modulation routine which continuously monitors various engine parameters in order to optimally maintain engine power under various road conditions.

According to this embodiment, as described above, when the throttle control system fails, higher and lower reference values are set that approximate the engine speed NE. Specifically, the fuel cut engine speed FNE, fuel supply engine speed FRT, lower limit engine speed NRT and other values, are set as reference values at a time just prior to the occurrence of failure. The individual injectors 5A to 5D are controlled in such a way that the engine speed NE1 fluctuates between the engine speeds FNE and FRT or between the engine speeds FNE and NRT during the intermittent fuel cutting process. This injector control is accomplished by the fuel modulation routine which continuously monitors various engine parameters in order to optimally maintain engine power under various conditions.

When the throttle control system fails, therefore, the injectors 5A to 5D instead of the subthrottle valve 8 are controlled to adjust the engine power. In addition, the control is performed in such a way that the engine speed NE1 is maintainable base on the current engine speed NE and individual engine speed parameters FNE, FRT, NRT, etc. immediately before the occurrence of the failure. Significantly, the engine speed and power modulation allows the engine's operator to recognize the occurrence of a throttle failure ad to maintain the vehicle at a level of performance substantially similar to that before the detected throttle valve failure. This results in improved vehicle drivability and control characteristics (Second Embodiment)

An engine power regulator according to a second embodiment of the present invention as adapted for use in an automobile will be described with reference to FIGS. 12 to 18. The gasoline engine system used in this embodiment is substantially the same as that of the first embodiment. To avoid repeating the description of these engine components, the same reference numerals used in the first embodiment will be used for these components in the second embodiment. According to this embodiment, the contents of the fuel injection control routine are the same as that of the first embodiment. For this reason, the contents of the fuel injection control routine here will be omitted.

This embodiment differs from the first embodiment in the processing contents of the fuel cutting routine. Practically speaking, when the driver increases his demand for acceleration by stepping on the accelerator pedal 10, during a throttle system malfunction, fuel modulation is adjusted to reflect the drivers increased demand for acceleration. This is accomplished by incorporating time based values in the fuel cutting routine to control the setting the engine speed limits FNE and FRT at a rate more frequent than was done in the fuel cutting routine of the first embodiment.

FIGS. 12 to 16 present flowcharts illustrating the fuel cutting routine that is executed by the first ECU 51. The initial processes of this routine 301–308 are the same as those of the steps 101–108 describing the first embodiment as shown in FIG. 5. Their description here, therefore, will be omitted.

At step 309 following any of steps 305 to 308, the ECU 51 determines whether or not the fuel cutting execution flag XFC is "1". When the fuel cutting execution flag XFC is "0", the ECU 51 recognizes engine has resumed its normal fuel injection state from a fuel cutting state and increments a post cutting time CTJ by a predetermined time. Post cutting time CTJ represents the time elapsed after normal fuel injection has resumed following fuel cutting. When the fuel cutting execution flag XFC is "1" in step 309, the ECU 51 increments a periodic modulation time value CTM, as the time elapsed during a period of fuel cutting, by a predetermined unit time in step 311.

Following the procedures at steps 310 or step 311, the ECU 51 determines at step 321 whether or not the current main throttle angle TAM is less than the predetermined value $\theta 1$. When the main throttle angle TAM is less than the predetermined value $\theta 1$, the ECU 51 proceeds to step 327. When this throttle angle TAM is equal to or greater than the predetermined value $\theta 1$, the ECU 51 advances to step 322. There at step 322, the ECU 51 determines whether or not the post cutting time CTJ is equal to or greater than a predetermined value T2 ("sec" as a unit). When the time CTJ is equal to or greater than the predetermined value T2, the ECU 51 advances to step 327. Alternatively, should time CTJ be less than the pro,determined value T2, the ECU 51 proceeds to step 323.

At step 323, the E(U 51 next determines whether or not the fuel supply engine speed FRT at the end of a fuel modulation period is equal to or greater than the fuel cut engine speed FNE at the beginning of a fuel modulation period. As in the previous embodiment, engine speed FRT is determinative of when normal fuel injection occurs, while engine speed FNE is determinative of when fuel cutting occurs. When the ECU 51 determines at step 323 that the engine speed FRT is equal to or greater than engine speed FNE, the ECU 51 proceeds to step 327, otherwise the ECU 51 proceeds to step 324.

At step 324, the ECU 51 determines if the modulation routine time value CEX is equal to or greater than a predetermined value T3 ("sec" as a unit; T3>T2). Value CEX is measured in a separate processing routine. This time CEX indicates the time elapsed from the beginning of fuel cutting. When the time CEX is equal to or above the predetermined value T3 in step 324, the ECU 51 proceeds to step 327 otherwise the ECU 51 proceeds to step 325. There, at step 325, the ECU 51 determines if the aforementioned request flag XRQ is "1". When this flag XRQ is "1", the ECU 51 proceeds to step 331, where it will check to see if fuel cutting is still requested by determining the value of flag XRQ.

When flag XRQ is determined to be "0" at step 325, the ECU 51 proceeds to step 326 where the ECU 51 determines whether or not the throttle response time CDP is less than the predetermined value T1 ("ms" as a unit). When time CDP is smaller than the predetermined value T1, the ECU 51 considers that the change in engine power indicates the need for fuel cutting, and move to step 331. When time CDP is equal to or greater than the predetermined value T1, the ECU 51 moves to step 327.

Following the procedure at any of the steps 321–324 or at 326, the ECU 51 recognizes that the throttle control system is not malfunctioning, and sets the subthrottle failure flag XTF to "0". Next at step 328, the ECU 51 considers that no fuel cutting is necessary and sets the request flag XRQ to "0". From either step 325, 326 or 328, the ECU 51 next, at step 331, determines if the request flag XRQ is "1". When this flag XRQ is "0", the ECU 51 considers that the throttle control system is normal and no fuel modulation is necessary, and then goes to step 332 to execute a sequence of processes in steps 332 to 342.

At step 332, the ECI 51 sets the fuel cutting execution flag XFC to "0" to stop the fuel cutting. Then at step 333, the ECU 51 sets the fuel cutting period start flag XFN to "1" as a signal to offset the engine speed value FNE by preset value KFN at the beginning of the next modulation period. Next at step 334, the ECU sets a fuel modulation end flag XFR to "1" as a signal to offset the engine speed value FRT by preset value KFT at the end of a fuel modulation period. Alternatively, flags XFN and XFR are set to zero to indicate that engine speeds FNE and FRT should be maintained without being offset.

Following this at step 335, the ECU 51 adds the currently read engine speed NE1 and an offset value KNB, and determines if the sum is larger than the sum obtained by adding a lower limit engine speed NRT and a minimum engine speed range KYS. At step 335, when the sum of parameters NE1 and KNB is larger than the sum of parameters NRT and KYS, the ECU 51 proceeds to step 336. At this step 336, the ECU 51 sets the sum of parameters NE1 and KNB as the fuel cut engine speed FNE. Alternatively, at step 335, when the value resulting from the sum of NE1 and KNB is smaller or equal to the parameters NRT and KYS, the ECU 51 proceeds to step 337. The procedure at that step sets the sum of parameters NRT and KYS as the new fuel cut engine speed FNE.

Following the procedures carried out at step 336 or 337, the ECU 51 next at step 338 subtracts an preset value KRB from the currently set fuel cut engine speed FNE, and sets the sum as the fuel supply engine speed FRT. Next at step 339, the ECU 51 refers to an offset value KTB to initialize value FTM. Value KTB is a value controlling the periodicity of the fuel modulation routine. In subsequent periods, value FTM is offset by preset value KFT. Next at step 340, the ECU 51 resets the periodic modulation time value CTM to "0". At step 341 the ECU 51 resets the post cutting time CNJ to "0". Next at step 342, the ECU 51 resets the modulation routine time value CEX of the to "0" and then temporarily terminates the current cutting routine and begins a new routine. Should the request flag XRQ be "1" at step 331, then ECU 51 considers that the throttle control system has failed, and goes to step 351.

At step 351, the ECU 51 determines whether or not the fuel cutting execution flag XFC is "1". When the flag XFC is "0", the ECU 51 advances to step 352, considering that the condition has already returned to the normal fuel injection state from the fuel cutting state.

At step 352, the ECU 51 determines whether or not the currently read engine speed NE1 is equal to or greater than the current fuel cut engine speed FNE, set at the beginning of the fuel modulation period. When the engine speed NE1 is smaller than the fuel cut engine speed FNE, the ECU 51 considers that the normal fuel injection is in progress and temporarily terminates the current modulation routine. When the engine speed NE1 is equal to or above the fuel cut engine speed FNE, the ECU 51 proceeds to step 353. There, the ECU 51 determines whether or not the modulation routine time value CEX is equal to or above the predetermined value T3. When value CEX is equal to or above the predetermined value T3, the ECU 51 considers that the fuel cutting has been completed, temporarily terminates the current cutting routine and begins a new one. When the modulation routine time value CEX is less than the predetermined value T3, the ECU 51 proceeds to step 354.

At step 354, the ECU 51 determines whether or not the post cutting time CNJ is equal to or greater the predetermined value T2. When the post cutting time CNJ is equal to or above the predetermined value T2, the ECU 51 temporarily terminates the current modulation routine and begins a new routine. When the post cutting tie CNJ is less than the predetermined value T2, the ECU 51 considers that the conditions requiring fuel cutting have been satisfied, and moves to execute the process at step 355. At this step, the ECU 51 sets the fuel cutting execution flag XFC to "1" as a signal to execute fuel cutting. Next at step 356, the ECU 51 sets the fuel modulation period end flag XFR to "0" to permit the renewal of the fuel supply engine speed FRT. The ECU 51 resets the post cutting time CNJ to "0" in step 357.

The ECU 51 determines whether or not the cutting period start flag XFN is "1" at step 358. This flag XFN is set to "1" as a signal to offset the engine speed FNE by preset value KFN. Next the ECU 51 temporarily terminates the routine. When flag XFN is set to "0", it indicates the need for the resetting of the fuel cut engine speed FNE At step 359, the ECU 51 adds a value KFN to the fuel cut engine speed FNE ad sets the resultant value as a new fuel cut engine speed FNE. That is, the fuel cut engine speed FNE is incremented. A the next step 360, the ECU 51 sets the cutting period start flag XFN to "1" to inhibit the renewal of the fuel cut engine speed FNE, temporarily terminates the current modulation routine and begins a new routine.

Should the fuel cutting execution flag XFC be set to "1" at step 351, the ECU 51 considers that the fuel cutting has already been executed and goes to step 361 the current lower limit engine speed NRT is set as a remembered variable value RFC. At the next step 362, the ECU 51 determines whether or not the variable value RFC is larger than the current fuel supply engine speed FRT. Should value RFC be larger than FRT, the ECU 51 proceeds to step 363, otherwise the ECU 51 proceeds to execute the procedure at step 364. At step 363, the ECU 51 determines whether or not the current engine speed NE1 is smaller than the variable value RFC. When the engine speed NE1 is smaller than RFC, the ECU 51 goes to step 367, otherwise, the ECU 51 goes to step 365.

At step 364 following step 362, the ECU 51 determines whether or not the current engine speed NE1 is smaller than the fuel supply engine speed FRT. If the speed NE1 is smaller, the ECU proceeds to step 37, otherwise the ECU 51 proceeds to step 365. There at step 365, the ECU 51 determines whether or not the modulation routine time value CEX is equal to or greater than the predetermined value T3. If it is, the ECU 51 moves to step 367, otherwise the ECU 51 moves to step 366.

At step 366, the ECU 51 determines if the periodic modulation time value CTM is less than the period limiting value FTM. When the former time CTM is less than the latter time FTM, the ECU 51 temporarily terminates the current cutting routine and begins a new routine. When the time CTM is equal to or greater than the period limiting value FTM, the ECU 51 proceeds to step 367. Once at step 367, from any one of steps 363 to 366, the ECU 51 sets the fuel cutting execution flag XFC to "0" to finish the fuel cutting. The ECU 51 then sets the cutting period start flag XFN to "0" in step 368 to allow for the resetting of the fuel cut engine speed FNE. At the next step 369, the ECU 51 resets the periodic modulation time value CTM to "0".

The ECU 51 next at step 370 determines whether the fuel cut engine speed FNE is larger than sum of value RFC and the minimum engine speed range KYS. When the value for FNE is larger than the this sum, the ECU 51 moves to step 372, otherwise the ECU 51 moves to step 371. There, at step 371, the ECU 51 sets the sum of value RFC and KYS as a new fuel cut engine speed FNE.

At step 372 following the step at 370 or 371, the ECU 51 determines whether or not the cutting period start flag XFR is "1". When this flag XFR is "1", it signals the ECU 51 to offset the engine speed FRT by preset value KFT. Following this, the ECU 51 temporarily terminates the current cutting routine and begins a new one. Alternatively, when flag XFR is "0", it indicates that ECU 51 should maintain engine speed FRT without incrementing it. The ECU 51 then moves to step 373.

At step 373, the ECU 51 increment engine speed FRT at the end of a fuel modulation period with offset value KFR and sets the resultant value as the current fuel supply engine speed FRT. The ECU 51 also increments value FTM by preset value KFT and sets the resultant value as the new modulating period limiting value FTM. At step 375, the ECU 51 sets the cutting period end flag XFR to "1" as a signal to offset the engine speed value FRT. ECU 51 next temporarily terminates the current cutting routine and begins a new routine.

The processing and calculation for the fuel cutting routine is executed in the above manner. Should the throttle control system malfunction, the fuel cutting execution flag XFC, used in the "fuel injection control routine", is set to "0" or "1" to execute the fuel cutting routine. Likewise, both cutting period start and end flags, XFN and XFR respectively, are set to "0" or "1".

A graphical illustration of the fuel modulation routine according to the second embodiment will be now described with reference to the graphs in FIGS. 17 and 18.

Figure 17:
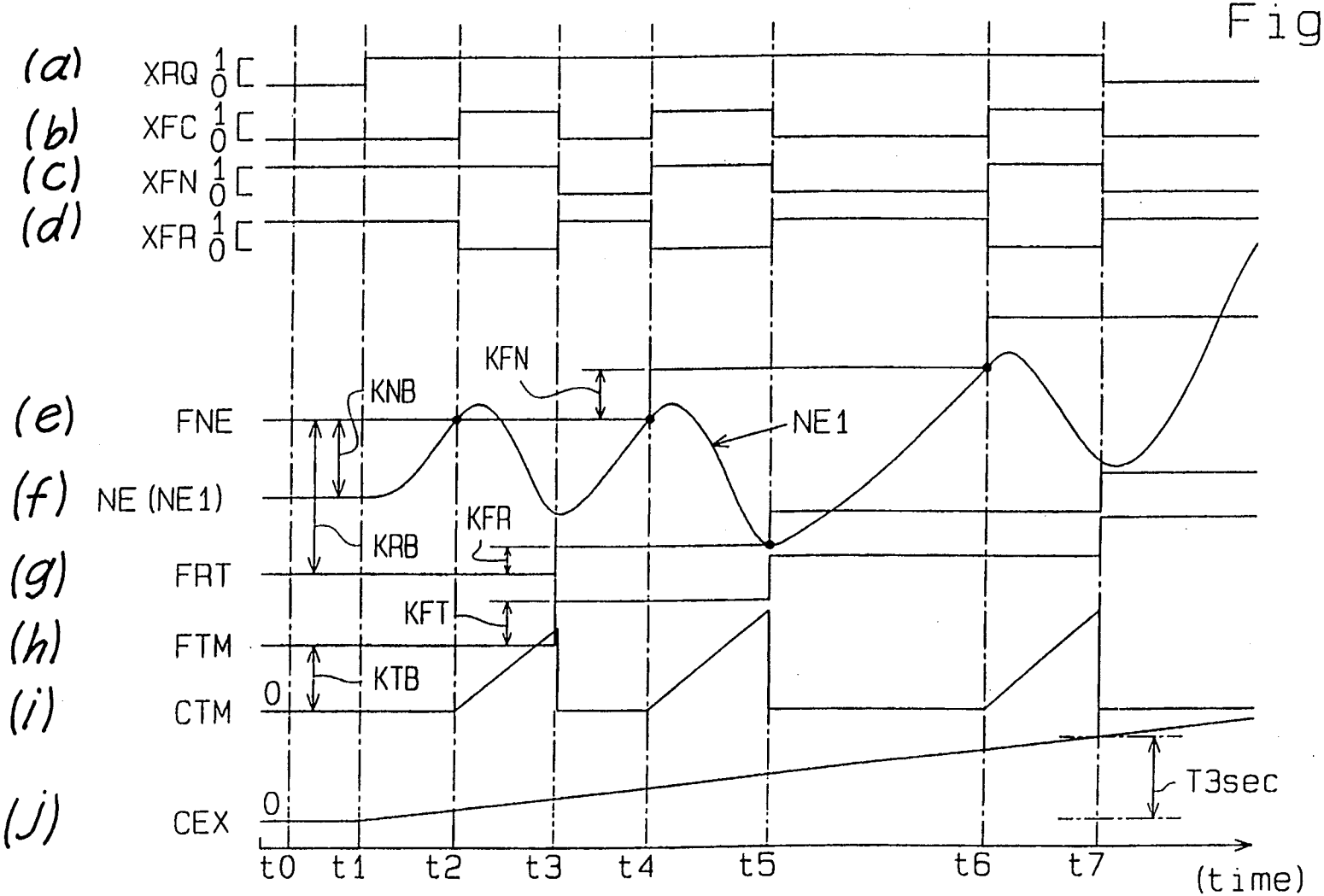

FIG. 17 shows the relationship among of the engine speed NE, the fuel cut request flag XRQ, the fuel cutting execution flag XFC, the cutting period start flag XFN and the fuel cutting period end flag XFR. FIG. 17 also illustrates the relation among the fuel cut engine speed FNE, the fuel supply engine speed FRT, the modulation period limiting value FTM, the periodic modulator time value CTM and the modulation routine time CEX. According to the present embodiment, and as reflected in the graph, it is assumed that when subthrottle valve 8 fails in the open position, the driver continues to depress the acceleration pedal 10 in order to demand more acceleration.

Assuming the normal functioning of that the throttle control system at time t0, both the fuel cut request flag XRQ and the fuel cutting execution flag XFC are set to "0" and the cutting period start flag XFN and the cutting period end flag XFR are both set to "1". A this time the resetting of the fuel cut engine speed FNE and the fuel supply engine speed FRT is allowed. The engine speed FNE and FRT are determined by reference to incremental offsetting values. A fuel cut engine speed FNE is set by offsetting engine speed NE with value KNB. A fuel supply engine speed FRT is set by offsetting value FNE by preset value KRB. Also at this time, the fuel cut periodic modulation time value CTM is reset to "0" and the initial value KTB alone is set as the modulation period limiting value FTM. Finally, the modulation routine time value CEX is also reset to "0".

When the throttle control system fails at time t1, the engine speed NE1 starts increasing and the request flag XRQ is set to "1". At this time, the elapsed modulation routine time value CEX is initialized to record to time elapsed during the modulation. When the engine speed NE1 reaches FNE at time t2, the fuel cutting execution flag XFC is set to "1" and the first fuel cutting starts. As a result, the engine speed NE1 starts falling. The cutting period end flag XFR is then set to "0" and the periodic modulation time value CTM gets incremented.

When CTM goes above the modulation period limiting value FTM at time t3, the fuel cutting execution flag XFC is set to "0". This terminates the fuel cutting, and normal fuel injection resumes. Consequently, the engine speed NE1 starts rising. At this time, the periodic modulation time value CTM is reset to "0" and the value FTM gets incremented by the value KFT. After the fuel supply engine speed FRT is incremented by the value KFR, the cutting period end flag XFR is set to "1", and the cutting period start flag XFN for the fuel cut engine speed is set to "0".

When the engine speed NE1 reaches the fuel cut engine speed FNE at time t4, the fuel cutting execution flag XFC is set to "1" and fuel cutting starts again. As a result, the engine speed NE1 starts falling again The cutting period end flag XFR is set to "0" and periodic modulation time value CTM gets incremented. Fuel cut engine speed FNE is incremented by the value KFN, and then the cutting period start flag XFN is set to "1".

When the engine speed NE1 drops to the fuel supply engine speed FRT at time t5 before the periodic modulation time value CTM reaches the modulation period limiting value FTM, the fuel cutting execution flag XFC is set to "0". Consequently, the fuel cutting is terminated, and the normal fuel injection is resumed. At this time, the periodic modulation time value CTM is reset to "0" and the modulation period limiting value FTM is incremented by the value KFT. After the fuel supply engine speed FRT is incremented by the value KFR, the cutting period end flag XFR is set to "1". Also at this time, the cutting period start flag XFN is set to "0".

After this, when the driver keeps stepping on the acceleration pedal 10 to keep the :main throttle valve 9 open, the engine speed NE1 at time t6 reaches a fuel cut engine speed FNE higher than the engine speed at t4. Consequently, the fuel cutting execution flag XFC is set to "1", fuel cutting starts again and the engine speed NE1 starts falling again. The cutting period end flag XFR then is set to "0" periodic modulation time value CTM is incremented. The fuel cut engine speed FNE then is incremented by the value KFN, and then the cutting period start flag XFN gets set to "1".

When the modulation routine time value CEX reaches the predetermined value T3 at time t7, the request flag XRQ changes to "0" and the fuel cutting execution flag XFC changes to "0". Consequently, the fuel cutting is terminated, the normal fuel injection is resumed, and the subsequent fuel cutting is inhibited.

At this time, the periodic modulation time value CTM is reset to "0" and the modulation period limiting value FTM is incremented by the value KFT. In addition, the fuel supply engine speed FRT is incremented by the value KFR, and the cutting period end flag XFR is set to "1". The cutting period start flag XFN then gets set to "0".

According to this embodiment, the injectors 5A to 5D rather than the subthrottle valve 8 are controlled to adjust the engine power. The engine speed NE1 at the failure time is so controlled as to maintain the value of the engine speed NE between values FNE and FRT in order to approximate and maintain the engine speed NE just prior to a throttle valve malfunction. When a failure occurs, therefore, the engine speed NE1 is maintainable. Should the driver at that time make an increased demand for acceleration, the engine power will increase accordingly despite the fact that fuel modulation is taking place. Due to the fact that the engine 1 can accelerate even on occurrence of a throttle failure, not only can the driver can smoothly manipulate and control the vehicle 30, but the driver can be made aware of the throttle malfunction by the modulation of the fuel supply to the engine 1.

Figure 18:
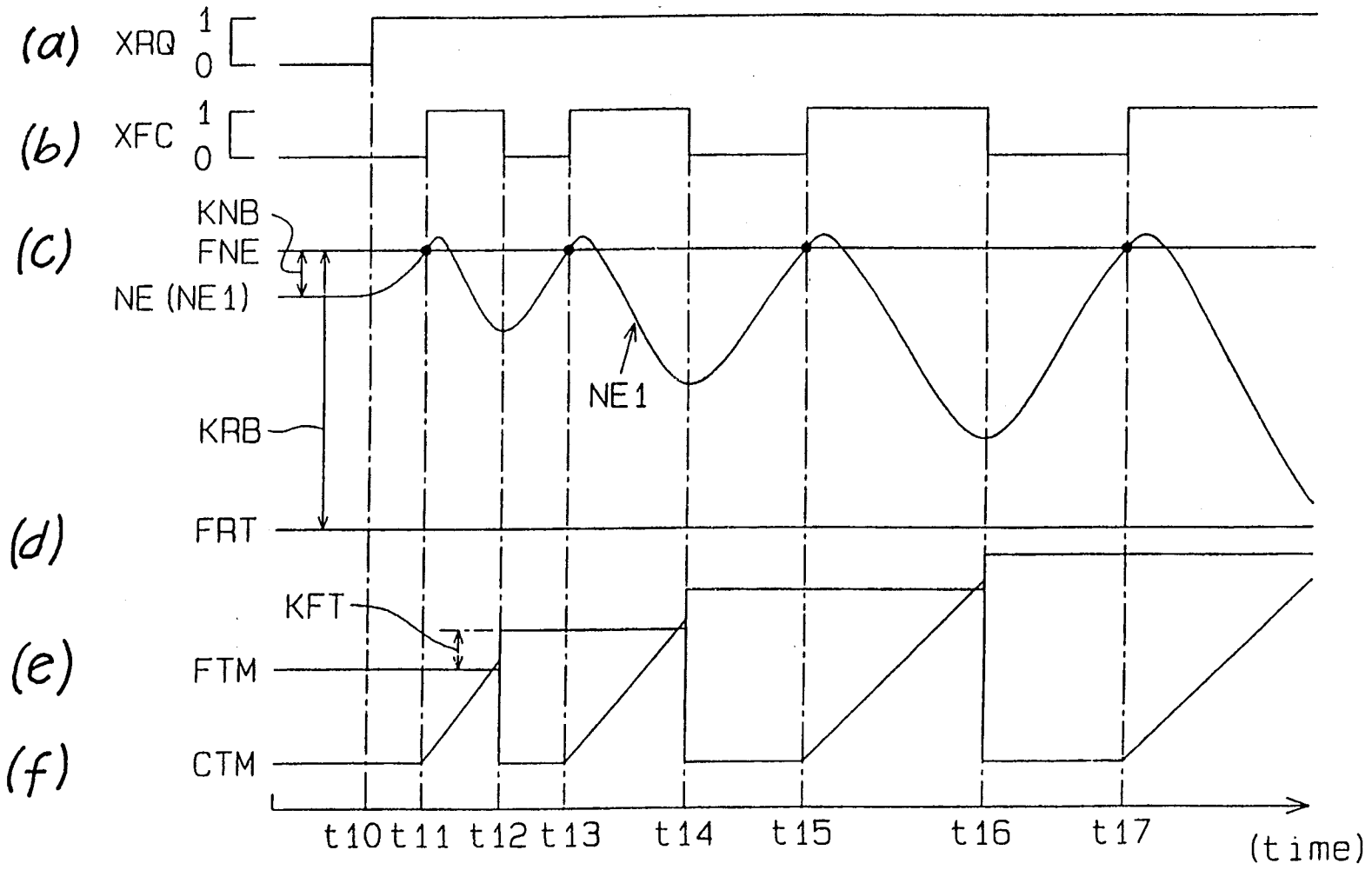

FIG. 18 shows the relation among the engine speed NE1, fuel cut engine speed FNE and fuel supply engine speed FRT, and how these values are effected by offset values KNB and KRB when the fuel cut request flag XRQ changes to "1". FIG. 18 also shows the behaviors of the fuel cut cutting execution flag XFC, modulation period limiting value FTM and periodic modulation time value CTM.

When the throttle control system fails at time t10, the engine speed NE1 starts increasing and the request flag XRQ is set to "1". Next, at time t11, when the engine speed NE1 reaches the fuel cut engine speed FNE, the fuel cutting execution flag XFC is set to "1" and the first fuel cutting starts. As a result, the engine speed NE1 starts falling, and periodic modulation time value CTM is incremented.

When value CTM rises above the modulation period limiting value FTM at time t12, the fuel cutting execution flag XFC gets set to "0", fuel cutting is terminated, and the normal fuel injection resumes. Consequently, the engine speed NE1 starts to increase. At this time, the periodic modulation time value CTM gets reset to "0" and the fuel cut modulation period limiting value FTM is incremented by value KFT.

When the engine sped NE1 reaches the fuel cut engine speed FNE at time t13, the fuel cutting execution flag XFC is set to "1" and fuel cutting starts again. As a result, the engine speed NE1 starts falling again, and periodic modulation time value CTM once again gets incremented. When the periodic modulation time value CTM exceeds the modulation period limiting value FTM at time t14, the fuel cutting execution flag XFC gets set to "0", fuel cutting is terminated, and the normal fuel injection once again resumes. As a result, the engine speed NE1 starts increasing the periodic modulation time value CTM gets reset to "0" and the modulation period limiting value FTM gets incremented by the value KFT.

After time t15, the fuel cutting execution flag XFC is set to begin fuel cutting until the engine speed NE1 falls below the fuel supply engine speed FRT. Again, value CTM gets incremented and reset as does the modulation period limiting value FTM.

Accordingly, when the throttle fails in the above case, the fuel cut speed FNE and supply engine speed FRT are set as first and second engine speed values defining a range of engine speeds. This range approximates that of engine speed NE. On the occurrence of a failure, injectors 5A through 5D are controlled by the fuel cutting and supply routines to modulate the delivery of fuel to the engine 1. This modulation of engine speed NE1 and engine power not only permits the driver of the vehicle to recognize that a malfunction has occurred in the throttle control system, but also allows the driver to maintain vehicle operation at speeds and power which the driver expects, even under conditions where the driver demands more acceleration. Thus when a throttle system malfunction occurs, the usual effects of such a malfunction may be avoided by modulation of the engine speed power as accomplished in the above embodiment.

(Third Embodiment)

A throttle valve controller for an engine according to a third embodiment of the present invention as adapted for use in an automobile will be described with reference to FIGS. 19 to 21. The gasoline engine system used in this embodiment is substantially the same as that of the first embodiment. To avoid repeating the description of these engine components, the same reference numerals used in the first embodiment will be used for these components in the second embodiment.

This embodiment differs from the first and second embodiments in that a gear selection routine is used rather than a fuel modulation routine to regulate engine speed and power. This is accomplished by controlling the selective upshifting and downshifting of the automatic transmission 16 according to a gear downshift and a gear ratio control routine. Rather than basing the control on an upper and lower engine speed values, this embodiment modulates engine speed and consequently engine power based on the vehicle's speed SPD as detected by the vehicle speed sensor 41 or the like.

Figure 19:
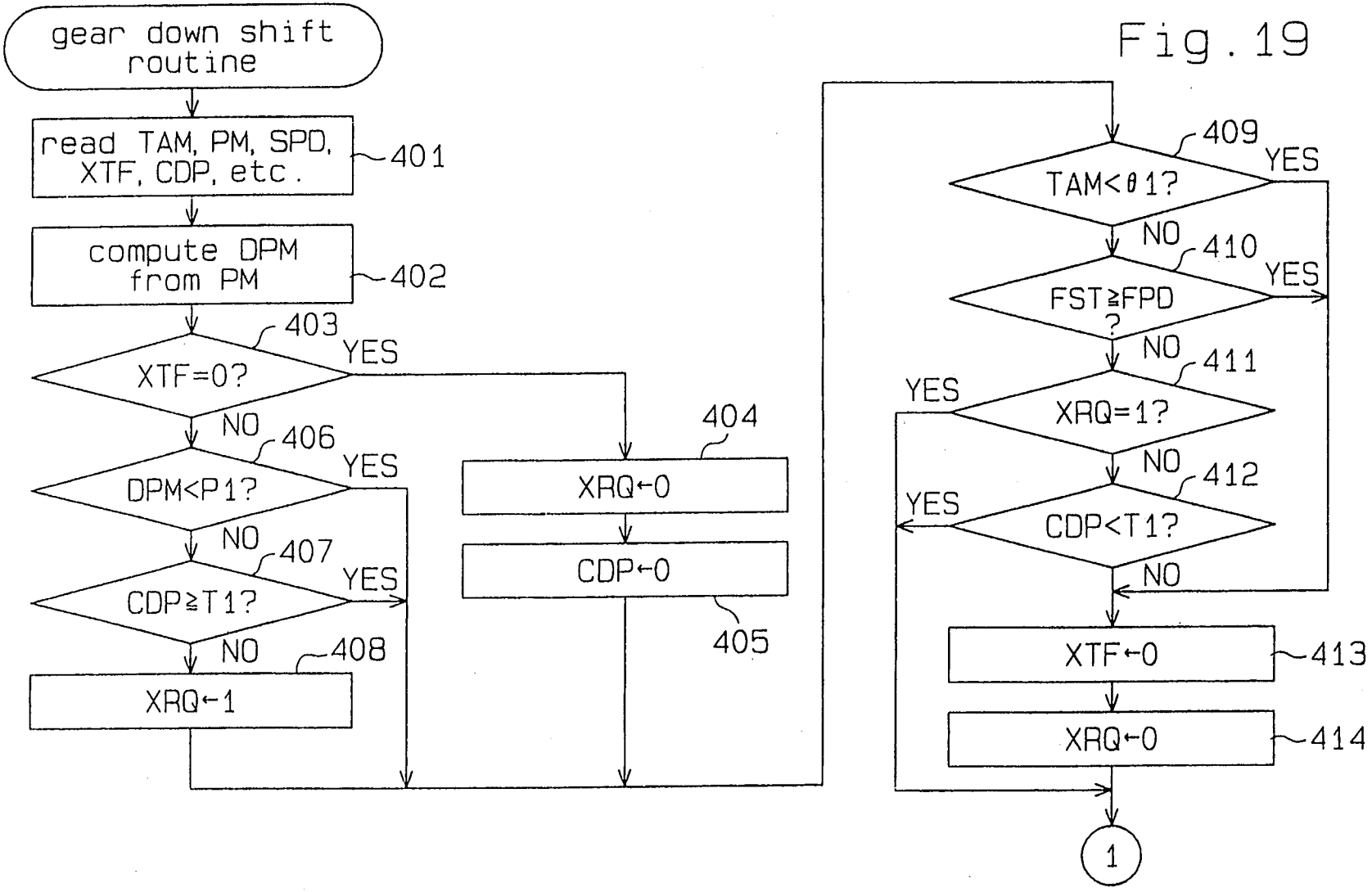
FIGS. 19 through 22 illustrate an engine power regulator according to a third embodiment of the present invention.
Figure 20:
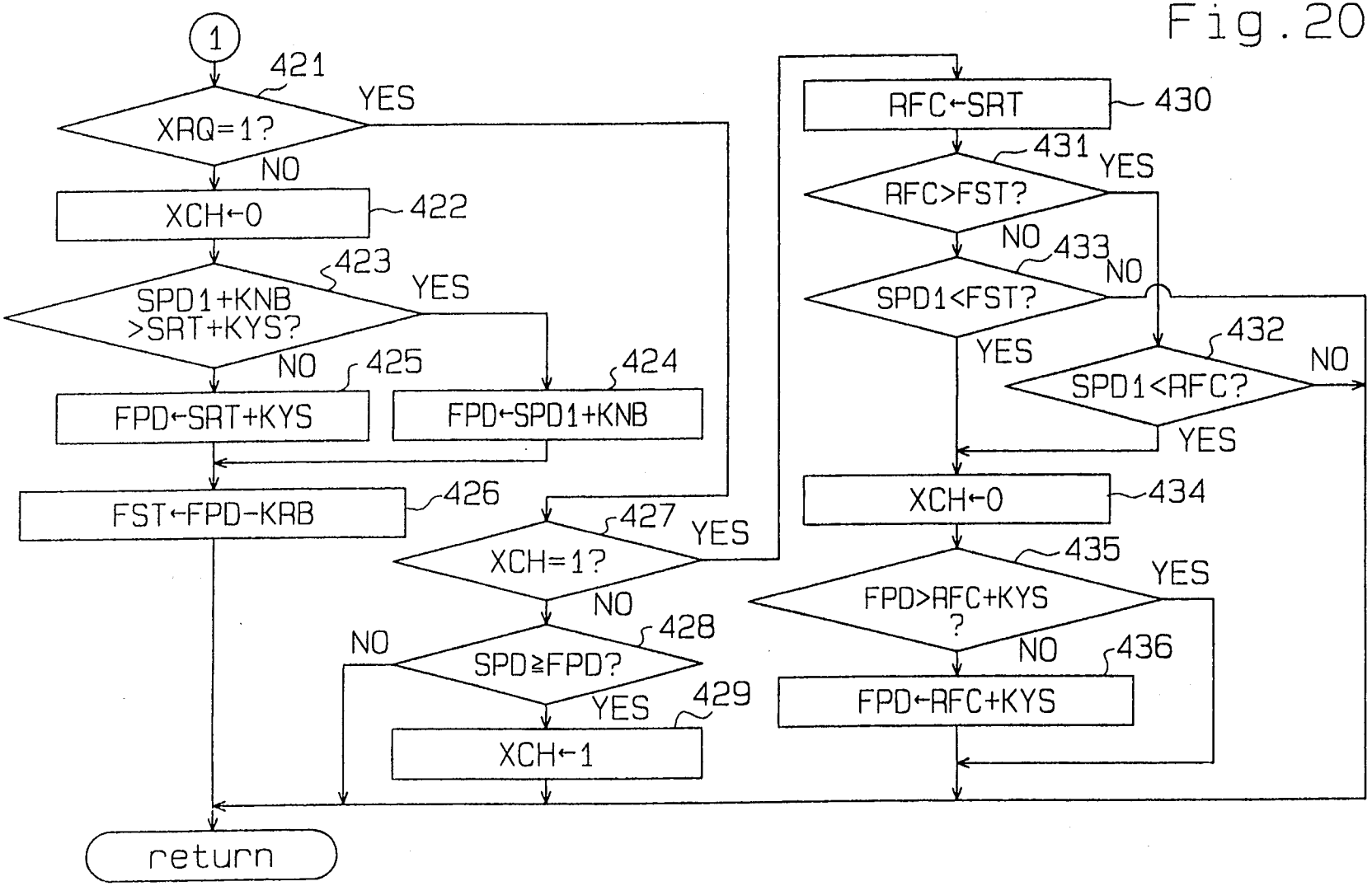

FIGS. 19 and 20 present flowcharts illustrating the gear downshift routine that is executed by the first ECU 51. Upon the routine's initialization, the ECU 51 executes processes in steps 401 to 408. These are essentially the same steps as the first five steps shown in FIGS. 5 and 6 of the first embodiment. Since the gear modulation routine is performed on the basis of the vehicle speed SPD in this embodiment, vehicle speeds SPD and SPD1 are used instead of the engine speeds NE and NE1 in steps 401, 423, 424, 428, 432 and 433 of the flowcharts illustrated in FIGS. 19 and 20. A down shift start vehicle speed FPD is used in place of the fuel cut engine speed FNE in steps 410, 424, 425, 426, 428, 435 and 436. A up shift vehicle speed FST is used in place of the fuel supply engine speed FRT in steps 410, 426, 431 and 433. Further, a lower limit vehicle speed SRT is used in place of the lower limit engine speed NRT in steps 423, 425 and 430. A down shift execution flag XCH is used in place of the fuel cut execution flag XFC in steps 422, 429 and 434.

In the flowcharts of this embodiment, the calculation for the gear modulation routine is performed. When the throttle control system fails, the gear change execution flag XCH used in a "gear ratio control routine" which will be discussed later is set to "0" or "1" to accomplish intermittent down shifting. The down shift gear change execution flag XCH permits downshifting when it is set to "1", and inhibits shift down when it is set to "0". As the intermittent down shifting is based on the vehicle speed SPD immediately before the occurrence of a throttle malfunction, the down shift vehicle speed SPD, down shift end vehicle speed FST, lower limit vehicle speed SRT, and other associated parameters are capable of being set in such a way that preserves the driving characteristics of the vehicle as they were prior to the detected malfunction.

Figure 21:
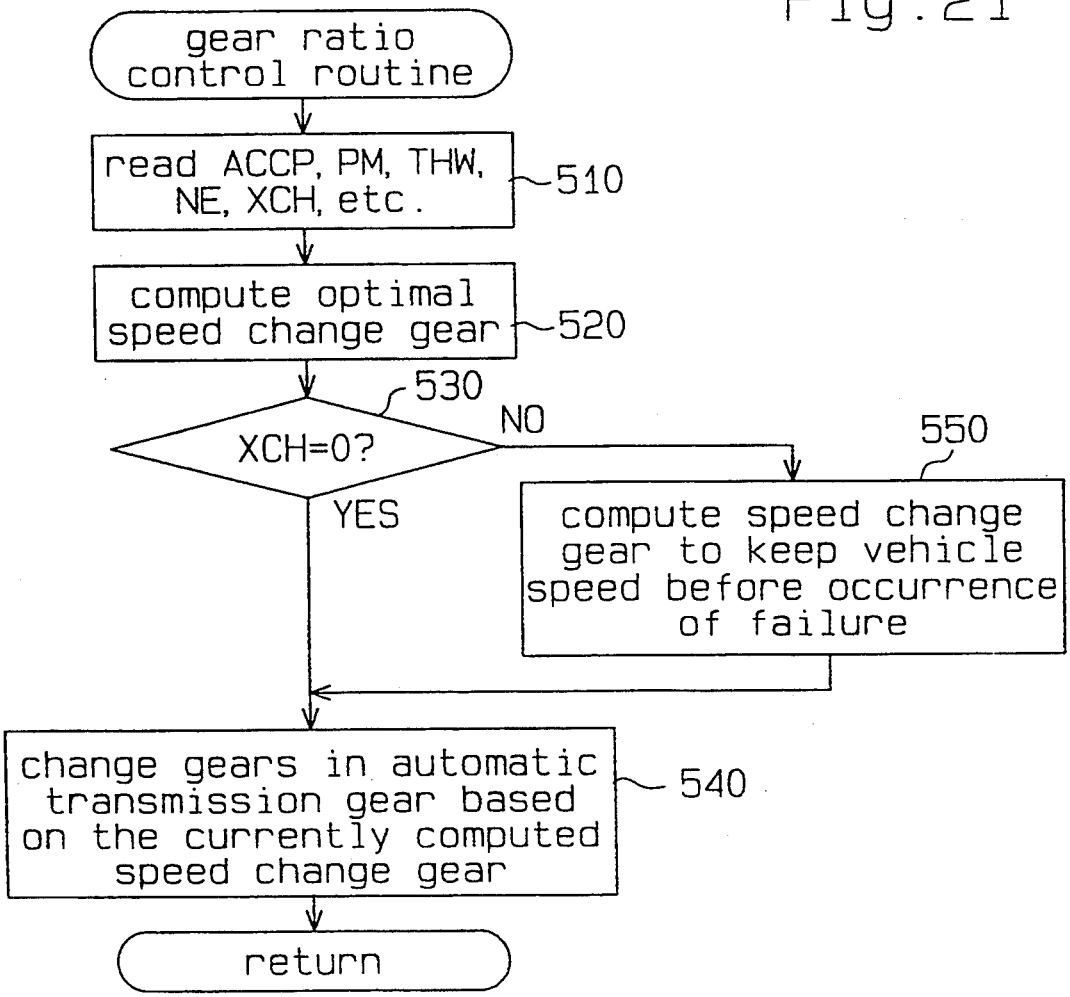

FIG. 21 presents a flowchart showing the "gear ratio control routine" that is executed by the first ECU 51. At the beginning, the ECU 51 reads individual parameters, such as ACCP, PM, THW and NE, as detected by the individual sensors 33, 34, 36, 37, etc. The ECU 51 also reads the down shift gear change execution flag XCH which is set in the "gear downshift routine". At the next step 520, the ECU 51 calculates the optimal speed change gear for the current driving conditions, based on the currently read parameters ACCP, PM, THW, NE, etc. Following this at step 530, the ECU 51 determines whether or not the currently read gear change execution flag XCH is "0". When this flag XCH is set to "0", the ECU 51 proceeds to step 540 to execute the normal transmission control. At this step 540, the ECU 51 drives the actuator **16*a* based on the optimal speed change gear, determined by the current calculation, to change the gears in the automatic transmission 16**, and then temporarily terminates the current gear ratio control routine.

When the flag XCH is "1" at step 530, down shifting is requested and the ECU 51 goes to step 550 to determine which speed gear should be used in order to maintain the vehicle speed SPD as it was immediately before the throttle malfunction. The ECU 51 then proceeds to step 540 to drive the actuator **16*a* to change the gears in the automatic transmission 16 based on the currently determined speed gear. The ECU 51** next temporarily terminates the gear ratio control routine.

Figure 22:
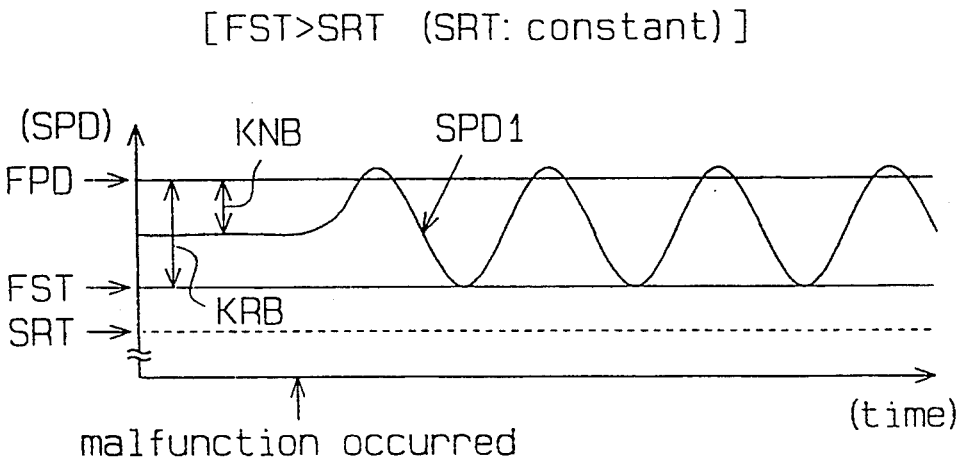

The gear ratio control of the automatic transmission 16 is executed in the above manner. One example of the results of executing the above gear modulation routine will be discussed below with reference to FIG. 22. It is assumed here that the up shift vehicle speed FST is higher than the constant lower limit vehicle speed SRT.

When a failure in the throttle control system is detected, the vehicle speed SPD immediately before the malfunction is used a reference value. The down shift start vehicle speed FPD is set by offsetting vehicle speed SPD with preset value KNB. The up shift vehicle speed FST is set by offsetting down shift vehicle speed FPD by preset value KRB. Of these two values, the up shift vehicle speed FST is higher than the lower limit vehicle speed SRT. Intermittent down shifting takes places between the down shift start vehicle speed FPD and the up shift vehicle speed FST. When the current vehicle speed SPD1 rises to the down shift start vehicle speed FPD, down shifting begins. Following his, when the vehicle speed SPD1 drops to the up shift vehicle speed FST, the down shifting ends and the normal transmission control resumes. When the vehicle speed SPD1 increases to the down shift start vehicle speed FPD again, down shifting once again resumes. Accordingly, the vehicle speed SPD1 is set to modulate between the down shift vehicle speed FPD and the up shift vehicle speed FST or between the down shift speed FPD and the lower limit vehicle speed SRT.

When an engine's throttle system malfunctions according to this embodiment, vehicle speed is maintained at a level consistent with that of the vehicle before the occurrence of the malfunction. Specifically, modulation of vehicle speed occurs within a range defined by an upper vehicle speed FST and a lower vehicle speed SRT or FST. According to a gear ratio and a down shift routine, the ECU 51 controls an actuator **16*a*** in the vehicle's automatic transmission, as a power moderating means, to selectively upshift and down shift the automatic transmission to achieve speeds ranging between the upper and lower vehicle speed limits. Like the first two embodiments, this effectively controls the engine's output power and thus maintains the vehicle's drivability and control characteristics at a level consistent with that of the vehicle prior to the throttle malfunction.

Although only three embodiments of the present invention have been described herein, it should be apparent to those skilled in the art that the present invention may be embodied in many other specific forms without departing from the spirit or scope of the invention. Particularly, it should be understood that this invention may be embodied in the following manner.

Figure 23:
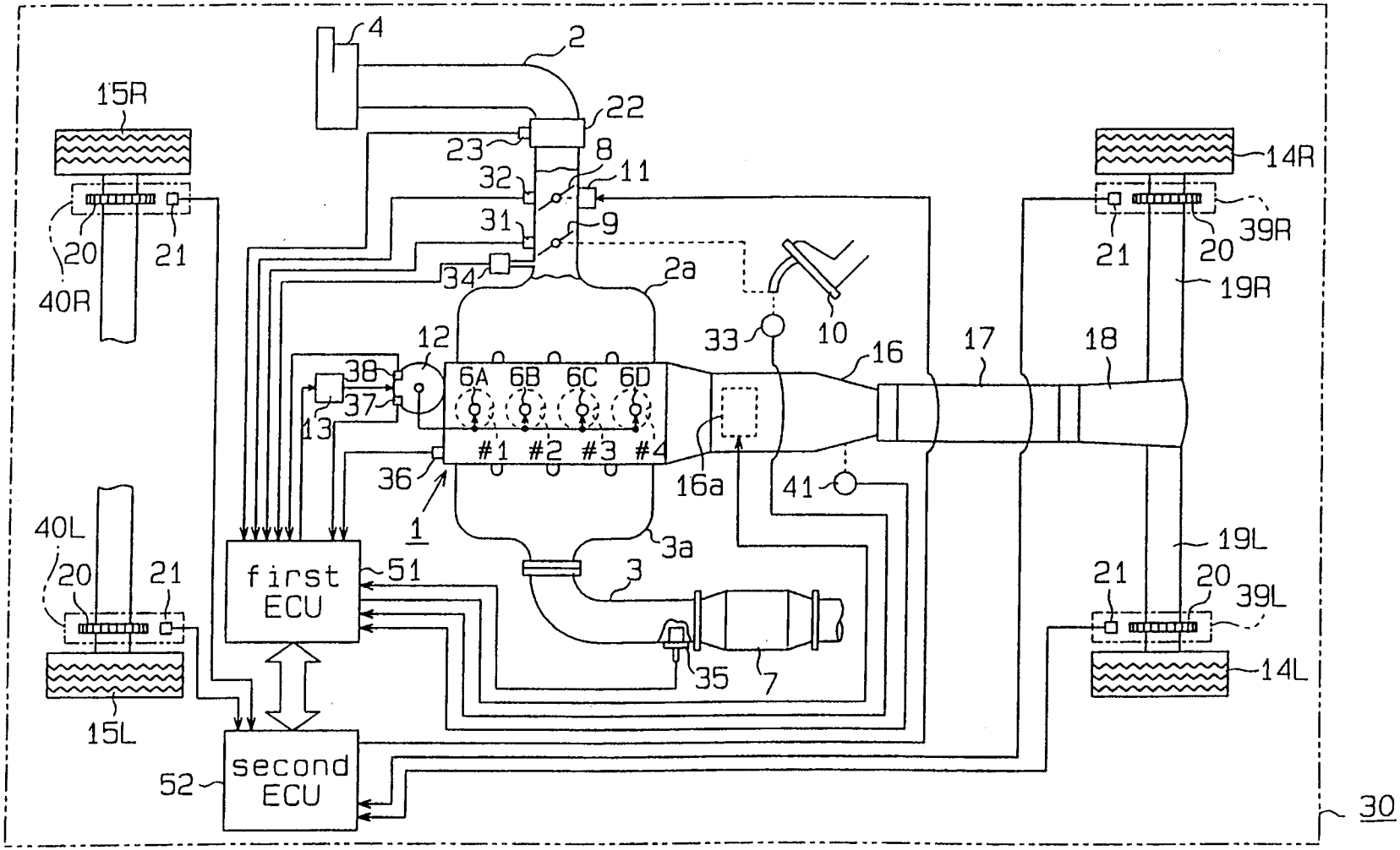
FIG. 23 is a schematic structural diagram showing a normally aspirated gasoline engine system adapted for a front engine rear wheel drive automobile according to an alternative embodiment of the resent invention.
Figure 24:
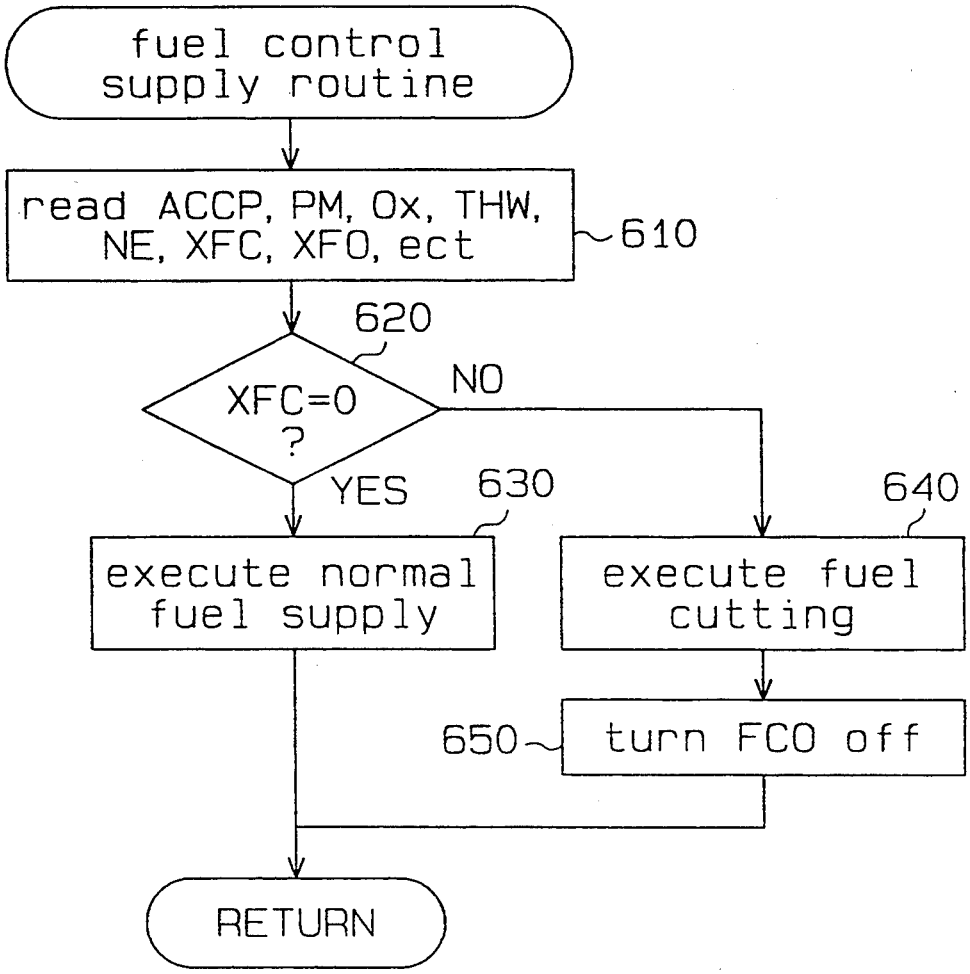
FIG. 24 is a flowchart illustrating a fuel control supply routine executed by a first ECU according to an alternative embodiment of the present invention.
Figure 25:
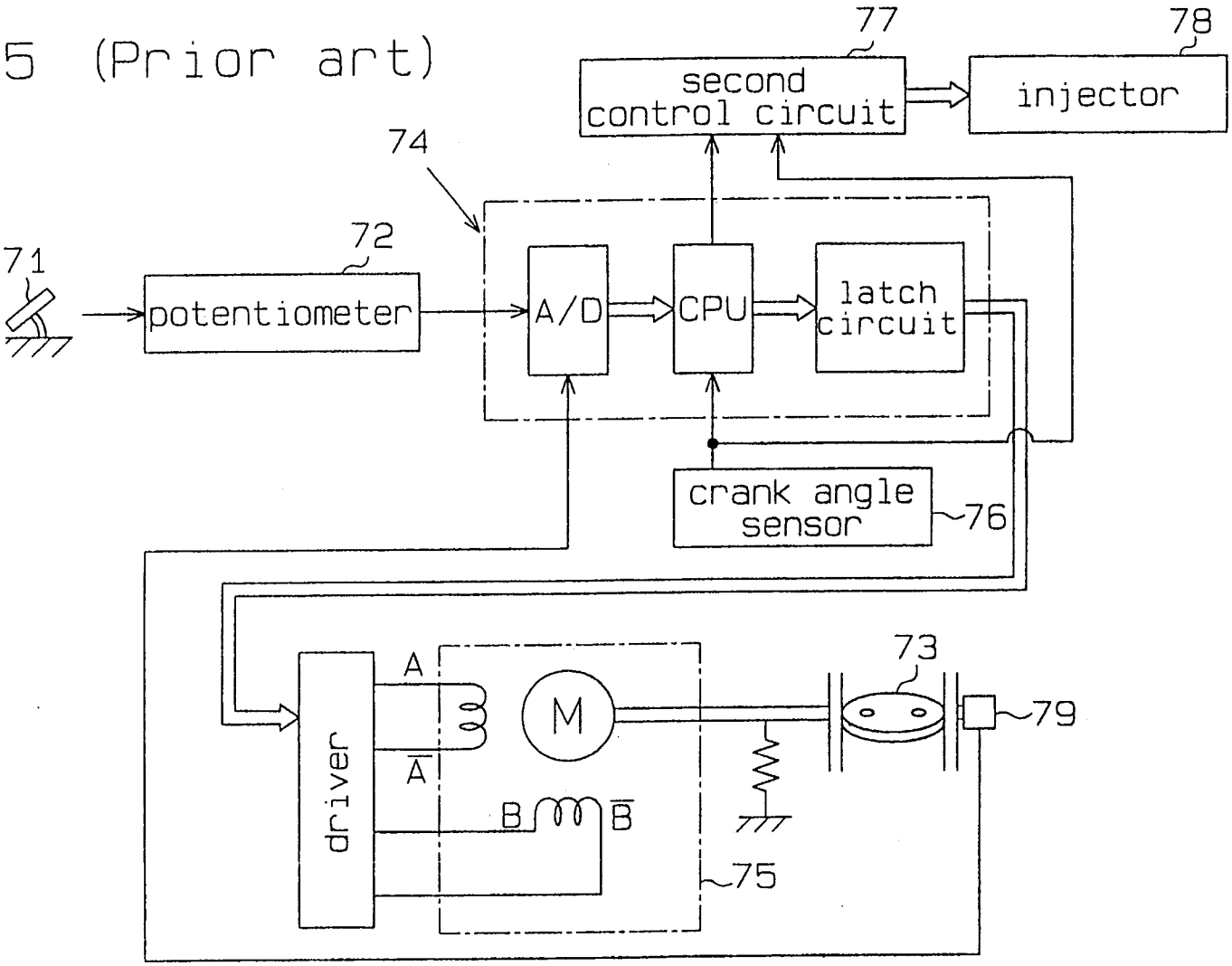
Fig.25 (Prior art)
FIG. 25 is a structural diagram schematically showing a conventional engine controller.

In the first through third embodiments of the present invention, fuel modulation has been described for an engine having fuel supplied by fuel infectors. The present invention, however, may be practiced using a normally aspirated fuel supply from a carburetor as illustrated in FIG. 23. There, a carburetor 22 is disposed along the air intake passage 2 between the air cleaner 4 and subthrottle valve 8. A cut off valve 23 is provided with the carburetor 22 to control the supply of fuel from the carburetor to the individual cylinder 1 through 4 based on control from the ECU 51. The fuel cut off valve 23 of carburetor 22 provides the functional equivalent of the fuel injectors described in the first through third embodiments. Accordingly, the fuel cut off valve 23 is regulated based on the fuel cutting described in FIG. 5–6 and FIG. 12–16. The fuel supply routine, according to this alternative embodiment is described in FIG. 24. This routine is identical to that described in FIG. 7 except for the reading of a fuel valve cut off flag XFO in step 610. There among the other parameters, the ECU 51 reads whether flag XFO has been set high or low in a separate routine. Based on the outcome at step 620, where the ECU determines whether the fuel cutting routine has set flag XFC high or low, the ECU proceeds either to step 630 to execute normal fuel supply through the carburetor 22 and cut off valve 23, or to execute fuel cutting at step 640 by turning the fuel cut off valve 23 on. After fuel cutting has been executed, the ECU 51 proceeds to step 650 where the ECU 51 turns the fuel cut off valve 23 off, and beings a new routine.

The individual embodiments employ a double-valve throttle consisting of the link type main throttle valve 9 and the linkless subthrottle valve 8. Moreover, a linkless one-valve throttle may be used as well.

If the second embodiment is adapted for a one-valve system, the engine speed NE1 can decrease smoothly by gradually reducing the fuel cut engine speed FNE and fuel supply engine speed FRT after a throttle malfunction is detected.

In the first embodiment, the fuel cut engine speed FNE and fuel supply engine speed FRT are set as reference values when a throttle malfunction occurs. Intermittent fuel cutting is executed in such a manner that when a malfunction occurs, the engine speed NE1 repetitively approaches to both engine speeds FNE and FRT. The fuel injection control may be carried out in such a way that when the throttle control system fails, the engine speed converges to one reference value that has been determined immediately before the occurrence of the malfunction.

In the first and second embodiments, intermittent fuel cutting is accomplished using the individual injectors 5A to 5D in the fuel modulation routine when the throttle control system fails. Alternatively, combustion in selected cylinders #1 to #4 of the engine may be prevented when the throttle control system fails. Alternatively, on occurrence of a failure in the throttle control system, the ignition timing control may be performed so that the ignition timing lags or leads in accordance with the actuation of the ignition plugs 6A to 6D.

According to the third embodiment, when the throttle control system fails, the automatic transmission 16 is intermittently shifted down based on the vehicle speed SPD in the gear modulation routine. The intermittent fuel cutting may be executed using the injectors 5A to 5D based on the vehicle speed SPD in the fuel modulation routine when the throttle control system fails.

Although the acceleration pedal 10 is manipulated by the driver in the individual embodiments, an acceleration lever or other type of operational members may be used as well.

According to the first and second embodiments, intermittent fuel cutting is executed based on the engine speed NE that is detected by the speed sensor 37 when the throttle control system malfunctions. Intermittent fuel cutting may be executed based on the vehicle speed SPD that is detected by the vehicle speed sensor 41 when the throttle control system malfunctions.

Although the above-described embodiments are adapted for use in the engine 1 having four cylinders #1 to #4, the present invention may be adapted for use in engines having more than four cylinders.

Therefore, the present examples and embodiment are to be considered as illustrative and not restrictive and the invention is not to be limited to the details given herein, but may be modifiers within the scope of the appended claims.

What is claimed is:

1. An apparatus for regulating power produced by a motor vehicle engine cooperating in association with a throttling means and engine power moderating means, said apparatus comprising:

first detecting means for detecting an operating condition of said engine and for generating a signal in response thereto;

second detecting means for detecting of a malfunction in said throttling means and for generating a signal in response thereto;

control means responsive to the signals generated by said first and second detecting means for generating first and second engine power values representative of a range of engine power in accordance with said operating condition prior to the occurrence of malfunction of said throttle means, said control means controlling said engine power moderating means to moderate engine power based on said first and second engine power values.

2. The apparatus according to claim 1, wherein said throttling means includes a sub-throttle valve controlled by the control means and a main throttle valve linked to the vehicle's accelerating member disposed in an air intake passage of said engine for controlling the amount of air provided to said engine.

3. The apparatus according to claim 1, wherein the first detecting means includes an engine speed sensor detecting the rotation of said engine, said engine speed sensor being disposed proximate to a distributor.

4. The apparatus according to claim 1, wherein the second detecting means includes one of a throttle valve angle sensor and a engine manifold pressure sensor, said throttle valve angle sensor being located in the vicinity of said sub-throttle valve to detect the angle of the sub-throttle valve in said air intake passage, and said engine manifold pressure sensor being attached to said air intake passage to detect the air pressure in said intake passage.

5. The apparatus according to claim 1, wherein said control means includes an Electronic Control Unit (ECU) coupled to said first and second detecting means and to said engine power moderating means, said ECU controlling the operation of the engine power moderating means by modulating engine speed based on said first and second engine power values generated by said ECU according to a fuel cutting routine and a fuel supply routine executed by said ECU in response to the signal generated by said second means.

6. The apparatus according to claim 1, wherein said control means includes a Electronic Control Unit (ECU) coupled to said first and second detecting means and to said engine power moderating means, said ECU controlling the operation of the engine power moderating means by modulating vehicle speed based on said first and second engine power values generated by said ECU according to a gear downshift routine and a gear ratio control routine executed by said ECU in response to the signal generated by said second means.

7. The apparatus according to claim 5, wherein said engine power moderating means includes a fuel injector controlled by said ECU to modulate engine speed by cutting and supplying fuel to said engine.

8. The apparatus according to claim 5, wherein said engine power moderating means includes a carburetor cooperated with a fuel cut off valve to regulate the supply of fuel to said engine, said fuel cut off valve being controlled by said ECU to modulate the supply of fuel to said engine based on said first and second engine power values.

9. The apparatus according to claim 6, wherein said engine power moderating means includes a transmission coupled to said engine for transmitting the rotational speed of said engine to driving wheels of said vehicle, said transmission having a plurality of gears selectively controlled by said ECU according to a gear modulation control routine that selectively upshifts and downshifts said transmission to modulate vehicle speed.

10. An apparatus for regulating power produced by a motor vehicle engine cooperating in association with throttling means and fuel injector means, said apparatus comprising:

first detecting means for detecting an operating condition of said engine and for generating a signal in response thereto;

second detecting means for detecting of a malfunction in said throttling means and for generating a signal in response thereto;

control means responsive to the signals generated by said first and second detecting means for generating first and second engine power values representative of a range of engine power in accordance with said operating condition prior to the malfunction of said throttle means, said control means controlling said fuel injector means to moderate engine power based on said first and second engine power values.

11. The apparatus according to claim 10, wherein said throttling means includes a sub throttle valve controlled by the control means and a main throttle valve linked to the vehicle's accelerating member disposed in an air intake passage of said engine for controlling the amount of air provided to said engine.

12. The apparatus according to claim 10, wherein the first detecting means include an engine speed sensor detecting the rotation of said engine, said engine speed sensor being disposed proximate to the engine's distributor.

13. The apparatus according to claim 10, wherein the second detecting means includes one of a throttle valve angle sensor and a engine manifold pressure sensor, said throttle valve angle sensor being located in the vicinity of said sub-throttle valve to detect the angle of the sub-throttle valve in said air intake passage, and said engine manifold pressure sensor being attached to said air intake passage to detect the air pressure in said intake passage.

14. The apparatus according to claim 10, wherein said control means includes an Electronic Control Unit (ECU) coupled said first and second detecting means and to said fuel injector means, said modulating the supply of fuel provided to said engine by said fuel injector means according to a fuel cutting and supply routines executed by said ECU in response to the signal generated by said second means, wherein said engine power is maintained based on said first and second engine power values.

15. An apparatus for regulating power produced by a motor vehicle engine cooperating in association with a throttling means and an engine power transmission means, said apparatus comprising:

first detecting means for detecting an operating condition of said engine and for generating a signals in response thereto;

second detecting means for detecting a malfunction in said throttling means and for generating a signal in response thereto;

control means responsive to the signals generated by said first and second detecting means for generating first and second engine power values representative of a range of engine power in accordance with said operating condition prior to the occurrence of the malfunction of said throttle means, said control means further operating to control said engine power transmission means to engine power based on said first and second engine power values.

16. The apparatus according to claim 15, wherein said engine power transmission means include an automatic transmission connected between said engine and an engine drive shaft for transmitting engine rotational speed data to said drive shaft, said transmission engine having a plurality of gears selectively chosen by said control means to control the output power of said engine.

17. The apparatus according to claim 15, wherein said throttling means includes a sub-throttle valve controlled by the control means and a main throttle valve linked to the vehicle's accelerating member disposed in an air intake passage of said engine for controlling the amount of air provided to said engine.

18. The apparatus according to claim 15, wherein the first detecting means includes an engine speed sensor detecting the rotation of said engine, said engine speed sensor being disposed proximate to the engine's distributor.

19. The apparatus according to claim 15, wherein the second detecting means includes one of a throttle valve angle sensor and an engine manifold pressure sensor, said throttle valve angle sensor being located in the vicinity of said sub throttle valve to detect the angle of the sub throttle valve in said air intake passage, and said engine manifold pressure sensor being attached to said air intake passage to detect the air pressure in said intake passage.

20. The apparatus according to claim 16, wherein said control means selectively control the gear ratio of said transmission by a gear ration control routine and a gear downshift routine executed by said control means in response to signal generated by second means, and wherein said engine power is maintained based on said first and second engine power values.

* * * * *

UNITED STATES PATENT AND TRADEMARK OFFICE

CERTIFICATE OF CORRECTION

PATENT NO. : 5,443,558

DATED : Aug. 22, 1995

INVENTOR(S) : Toshikazu Ibaraki et al.

It is certified that error appears in the above-indentified patent and that said Letters Patent is hereby corrected as shown below:

| Column | Line | |
|---|---|---|
| 1 | 10 | Change "modulation" to --modulating--. |
| 1 | 15 | Change "drivers" to --driver's--. |
| 1 | 25 | Change "couple" to --coupled--. |
| 2 | 27 | Change "vehicles" to --vehicle's--. |
| 2 | 32 | Change "ill" to --will--. |
| 2 | 39-40 | Change "throttles" to --throttle--. |
| 2 | 43 | Change "signals" to --signal--. |
| 2 | 45 | Delete "of"; change "throttles" to --throttle--. |
| 3 | 27 | Change ";he" to --the--. |
| 4 | 27 | Change "front wheel real wheel" to --front wheel--rear wheel--. |

UNITED STATES PATENT AND TRADEMARK OFFICE

CERTIFICATE OF CORRECTION

PATENT NO. : 5,443,558

DATED : Aug. 22, 1995

INVENTOR(S) : Toshikazu Ibaraki et al.

It is certified that error appears in the above-indentified patent and that said Letters Patent is hereby corrected as shown below:

| Column | Line | |
|---|---|---|
| 4 | 67 | Change "(no" to --(not--. |
| 5 | 9 | Change "b" to --by--. |
| 5 | 33 | Change "adjust" to --adjusts--. |
| 5 | 68 | Before "timing" delete "a". |
| 7 | 50 | After "setting" delete "a". |
| 7 | 51 | Change "defines" to --define--. |
| 8 | 14 | Change "set" to --sets--. |
| 9 | 38 | Change "an" to --any--. |
| 9 | 39 | Change "r" to --or--. |
| 9 | 42 | Change "o" to --to--. |
| 10 | 11 | Change "an" to --a--. |

UNITED STATES PATENT AND TRADEMARK OFFICE

CERTIFICATE OF CORRECTION

PATENT NO. : 5,443,558

DATED : Aug. 22, 1995

INVENTOR(S) : Toshikazu Ibaraki et al.

It is certified that error appears in the above-indentified patent and that said Letters Patent is hereby corrected as shown below:

| Column | Line | |
|---|---|---|
| 10 | 50 | Change "et" to --set--. |
| 10 | 56 | Change "he" to --the--. |
| 12 | 2 | Delete "with". |
| 13 | 16 | After "NRT" insert --and--. |
| 13 | 43 | Change "a" to --an--. |
| 13 | 46 | After "time" insert --of--. |
| 14 | 23 | Change "base" to --based--. |
| 14 | 27 | Change "allows" to --allow--. |
| 14 | 28 | Change "ad" to --and--. |
| 14 | 31 | After "characteristics" insert --.--. |
| 14 | 55 | After "setting" insert --of--. |

UNITED STATES PATENT AND TRADEMARK OFFICE

CERTIFICATE OF CORRECTION

PATENT NO. : 5,443,558

DATED : Aug. 22, 1995

INVENTOR(S) : Toshikazu Ibaraki et al.

It is certified that error appears in the above-indentified patent and that said Letters Patent is hereby corrected as shown below:

| Column | Line | |
|---|---|---|
| 15 | 22 | Change "pro,determined" to --predetermined--. |
| 15 | 24 | Change "E(U" to --ECU--. |
| 15 | 56 | Change "move" to --moves--. |
| 16 | 31 | Change "an" to --a--. |
| 16 | 42 | Delete "of the". |
| 17 | 10 | Change "tie" to --time--. |
| 17 | 30 | Change "A" to --At--. |
| 17 | 37 | After "361" insert --and--. |
| 18 | 24 | Change "increment" to --increments--. |
| 18 | 45 | After "among" delete "of". |

UNITED STATES PATENT AND TRADEMARK OFFICE

CERTIFICATE OF CORRECTION

PATENT NO. : 5,443,558

DATED : Aug. 22, 1995

INVENTOR(S) : Toshikazu Ibaraki et al.

It is certified that error appears in the above-indentified patent and that said Letters Patent is hereby corrected as shown below:

| Column | Line | |
|---|---|---|
| 18 | 58 | Delete "that". |
| 19 | 9 | Before "time" change "to" to --the--. |
| 19 | 49 | Change ":main" to --main--. |
| 20 | 23 | Change "effected" to --affected--. |
| 20 | 45 | Change "sped" to --speed--. |
| 20 | 55 | After "increasing" insert --,--. |
| 21 | 49 | Change "A" to --An--. |
| 22 | 41 | After "used" insert --as--. |
| 22 | 51 | Change "his" to --this--. |
| 23 | 19 | Change "infectors" to --injectors--. |
| 23 | 26 | Change "cylinder" to --cylinders--. |

UNITED STATES PATENT AND TRADEMARK OFFICE

CERTIFICATE OF CORRECTION

PATENT NO. : 5,443,558

DATED : Aug. 22, 1995

INVENTOR(S) : Toshikazu Ibaraki et al.

It is certified that error appears in the above-indentified patent and that said Letters Patent is hereby corrected as shown below:

| Column | Line | |
|---|---|---|
| 23 | 32 | Change "FIG. 5-6 and FIG. 12-16" to --FIGS. 5-6 and FIGS. 12-16--. |
| 24 | 34 | Change "embodiment" to --embodiments--. |
| 24 | 36 | Change "modifiers" to --modified--. |
| 25 | 3 | Before "engine" change "a" to --an--. |
| 25 | 21 | Before "Electronic" change "a" to --an--. |
| 26 | 14 | Before "engine" change "a" to --an--. |
| 26 | 23 | After "coupled" insert --to--. |
| 26 | 24 | Before "modulating" insert --ECU--. |
| 26 | 26 | Before "fuel" delete "a". |
| 26 | 36 | Change "signals" to --signal--. |

UNITED STATES PATENT AND TRADEMARK OFFICE

CERTIFICATE OF CORRECTION

PATENT NO. : 5,443,558

DATED : Aug. 22, 1995

INVENTOR(S) : Toshikazu Ibaraki et al.

It is certified that error appears in the above-indentified patent and that said Letters Patent is hereby corrected as shown below:

| Column | Line | |
|---|---|---|
| 26 | 54 | After "transmission" change "engine" to --means--; delete "data". |
| 27 | 6 | Change "sub throttle" to --sub-throttle--. |
| 27 | 7 | Change "sub throttle" to --sub-throttle--. |
| 28 | 5 | Change "ration" to --ratio--. |
| 28 | 7 | Before "signal" insert --a--; before "second" insert --the--. |

Signed and Sealed this

Thirtieth Day of January, 1996

*Attest:*

*Attesting Officer*

BRUCE LEHMAN

*Commissioner of Patents and Trademarks*